US012304720B2

(12) United States Patent
Chen

(10) Patent No.: US 12,304,720 B2
(45) Date of Patent: May 20, 2025

(54) LIQUID PRODUCT CONTAINER AND EXTENDING DRAWING UNIT OF LIQUID PRODUCT CONTAINER

(71) Applicant: MOTEDO CO., LTD., Taipei (TW)

(72) Inventor: Han-Liang Chen, Taipei (TW)

(73) Assignee: MOTEDO CO., LTD., Taipei (TW)

( * ) Notice: Subject to any disclaimer, the term of this patent is extended or adjusted under 35 U.S.C. 154(b) by 0 days.

(21) Appl. No.: 18/511,665

(22) Filed: Nov. 16, 2023

(65) Prior Publication Data

US 2024/0182231 A1 Jun. 6, 2024

(30) Foreign Application Priority Data

Dec. 5, 2022 (TW) ..... 111146641
Apr. 21, 2023 (TW) ..... 112115017

(51) Int. Cl.
*B65D 83/32* (2006.01)

(52) U.S. Cl.
CPC ..... *B65D 83/32* (2013.01)

(58) Field of Classification Search
CPC ..... B65D 83/32; B05B 15/30
USPC ..... 222/189.1
See application file for complete search history.

(56) References Cited

U.S. PATENT DOCUMENTS 1,963,056 A * 6/1934 Wilcox ..... E04C 3/07 473/322
2,950,031 A * 8/1960 Abplanalp ..... B65D 83/32 222/402.1
3,113,698 A 12/1963 Abplanalp
3,129,855 A * 4/1964 Malakoff ..... B65D 83/32 222/394
3,221,945 A * 12/1965 Davis, Jr. ..... A61M 11/008 222/211
3,311,274 A * 3/1967 Green ..... B65D 83/32 222/464.2
3,674,179 A * 7/1972 Galloway ..... B67D 1/0802 222/464.5
4,107,043 A 8/1978 McKinney
(Continued)

FOREIGN PATENT DOCUMENTS

CN 111204514 A 5/2020
FR 2998492 A1 5/2014
(Continued)

*Primary Examiner* — Paul R Durand
*Assistant Examiner* — Randall A Gruby
(74) *Attorney, Agent, or Firm* — RABIN & BERDO, P.C.

(57) ABSTRACT

A liquid product container has a container body, a valve, a liquid dip tube, and an extending drawing unit. The valve is sealed on the installing opening of the container body. The liquid dip tube is mounted on the valve. The extending drawing unit has a main body. The main body is mounted in the container body and extend to a bottom edge of the container body. The main body has multiple extending liquid drawing passages extending along a radial direction of the container body and respectively form multiple extending liquid drawing openings. The extending liquid drawing openings are located in the bottom edge of the container body. The main body has a connecting port segment connected to the extending liquid drawing passages and connected to the liquid dip tube, such that the liquid dip tube is connected to the extending liquid drawing openings.

16 Claims, 34 Drawing Sheets

(56) References Cited

U.S. PATENT DOCUMENTS 4,148,419 A * 4/1979 MacNair ..... B65D 83/425 222/464.2
4,245,760 A * 1/1981 Stevenson ..... A01M 7/0089 137/637.1
4,537,334 A * 8/1985 Spengler ..... A47L 13/30 222/401
4,630,759 A * 12/1986 Dawn ..... B67D 7/58 222/383.2
4,979,642 A 12/1990 Thiebaut
5,381,961 A * 1/1995 Evans ..... B65D 83/32 239/525
5,495,965 A * 3/1996 Knickerbocker ..... B05B 15/30 222/464.1
5,518,151 A * 5/1996 Knickerbocker ..... B05B 15/30 222/402.1
6,227,412 B1 * 5/2001 Sweeton ..... B05B 15/30 222/189.1
8,870,038 B2 * 10/2014 Nyambi ..... B65D 83/44 222/204
9,604,238 B2 * 3/2017 Geldard ..... B05B 15/30
10,105,726 B2 * 10/2018 Snyder ..... B05B 11/0037
10,252,836 B2 * 4/2019 Geldard ..... B65D 83/00
10,406,546 B2 * 9/2019 Rossignol ..... B05B 15/30
10,835,910 B2 * 11/2020 Goutayer ..... B05B 11/028
11,110,476 B2 * 9/2021 Meyers ..... B05B 9/085
2001/0030201 A1 * 10/2001 Gerhardt ..... B67D 1/10 222/333
2005/0279773 A1 * 12/2005 Byrd ..... B05B 11/1057 222/136
2009/0294468 A1 12/2009 Tom
2014/0151407 A1 * 6/2014 Zafrir ..... B05B 15/30 222/464.2
2015/0001259 A1 * 1/2015 Nguyen ..... B05B 15/30 222/464.2
2017/0100735 A1 4/2017 Taylor
2017/0128990 A1 5/2017 Soni
2022/0371815 A1 11/2022 Chen
2024/0182231 A1 * 6/2024 Chen ..... B05B 15/30

FOREIGN PATENT DOCUMENTS

JP 2015182778 A 10/2015
TW 1755223 B 2/2022

* cited by examiner

LIQUID PRODUCT CONTAINER AND EXTENDING DRAWING UNIT OF LIQUID PRODUCT CONTAINER

BACKGROUND OF THE INVENTION

1. Field of the Invention

The present invention relates to a liquid product container, especially to an extending drawing unit that is mounted on an end of a liquid dip tube to draw liquid product in every direction at a bottom edge of a container body, and especially to a liquid product container having the extending drawing unit.

2. Description of the Prior Art(s)

With reference to FIGS. 27 and 28, a conventional liquid product container has a container body 91, an aerosol valve 92, an actuator 93, and a liquid dip tube 94. The aerosol valve 92 is mounted on a top opening of the container body 91. The actuator 93 is mounted on a top end of the aerosol valve 92 and is located outside the container body 91. The liquid dip tube 94 is mounted on a bottom end of the aerosol valve 92 and is located in the container body 91. The liquid dip tube 94 extends curvedly to a bottom corner of the container body 91 so that a drawing end opening 941 can be located in the bottom corner of the container body 91 to draw liquid product C as much as possible to prevent the liquid product C remaining in the container body 91 and wasting.

Although the conventional liquid product container is capable of spraying regularly by the abovementioned configuration when the container body 91 is placed upright (with reference to FIG. 27), since the liquid dip tube 94 extends curvedly with the drawing end opening 941 toward a same direction as a spray nozzle 931 of the actuator 93 mounted on the top of the container body 91 and the drawing end opening 941 is attached to the bottom corner of the container body 91 (with reference to FIGS. 27 and 28), when the capacity of the liquid product C in the container body 91 is only a half or less, if the container body 91 is placed with the actuator 93 lean back or placed horizontally, the actuator 93 still cannot spray out the liquid product C even though there is remaining of the liquid product C because the drawing end opening 941 is not immerged in the liquid product C (as shown in FIG. 28), which causes inconvenience of use and leads to residual of the liquid product C.

To overcome the shortcomings, the present invention provides a liquid product container and an extending drawing unit of the liquid product container to mitigate or obviate the aforementioned problems.

SUMMARY OF THE INVENTION

The main objective of the present invention is to provide an extending drawing unit of the liquid product container that is adapted to be mounted on an end of a liquid dip tube and has multiple extending liquid drawing openings to make the liquid dip tube capable of drawing liquid product in multiple directions from a bottom inside the liquid product container.

The liquid product container has a container body, a valve, a liquid dip tube, and an extending drawing unit. The container body is hollow and has an installing opening. The valve is sealed on the installing opening of the container body. The valve has a liquid product inlet and a liquid product outlet. The liquid product inlet is located in the container body. The liquid product outlet is located outside the container body. The liquid product inlet is connected to the liquid product outlet. The extending drawing unit has a main body. The main body is adapted to be mounted in the container body and is adapted to extend to a bottom edge of the container body. The main body has multiple extending liquid drawing passages formed inside the main body. Each one of the extending liquid drawing passages extends along a respective one of radial directions of the container body. The extending liquid drawing passages respectively form multiple extending liquid drawing openings on an annular side surface of the main body. The extending liquid drawing openings are arranged annularly, are spaced apart from each other, and are adapted to be located in the bottom edge of the container body. The main body has a connecting port segment connected to the extending liquid drawing passages and adapted to be connected to the liquid dip tube, such that the liquid dip tube is connected to the extending liquid drawing openings.

The advantages of the liquid product container of the present invention are as follows. The main body is located in the container body and extends to the bottom edge of the container body. The main body forms multiple extending liquid drawing passages inside, and the extending liquid drawing passages extend along the radial direction of the container body and respectively form multiple extending liquid drawing openings which spaced apart to each other and arranged annularly on the side surface of the main body. Therefore, the extending liquid drawing openings attach to the bottom corner where the can wall and the can bottom connect to each other. Besides, the connecting port segment connect the liquid dip tube and the extending liquid drawing passages so the liquid dip tube connects the extending liquid drawing openings, and thus the liquid dip tube can be extended to the bottom corner of the container body in multiple directions. By the abovementioned configurations, even though the capacity of the liquid product in the container body is only a half or less, when the user changes the container body upright to use in a reclined state or in a horizontal state, there will be at least one extending liquid drawing opening submerged in the liquid product, such that the liquid dip tube can draw the liquid product in different directions, thereby the actuator sprays the liquid product correctly and smoothly.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
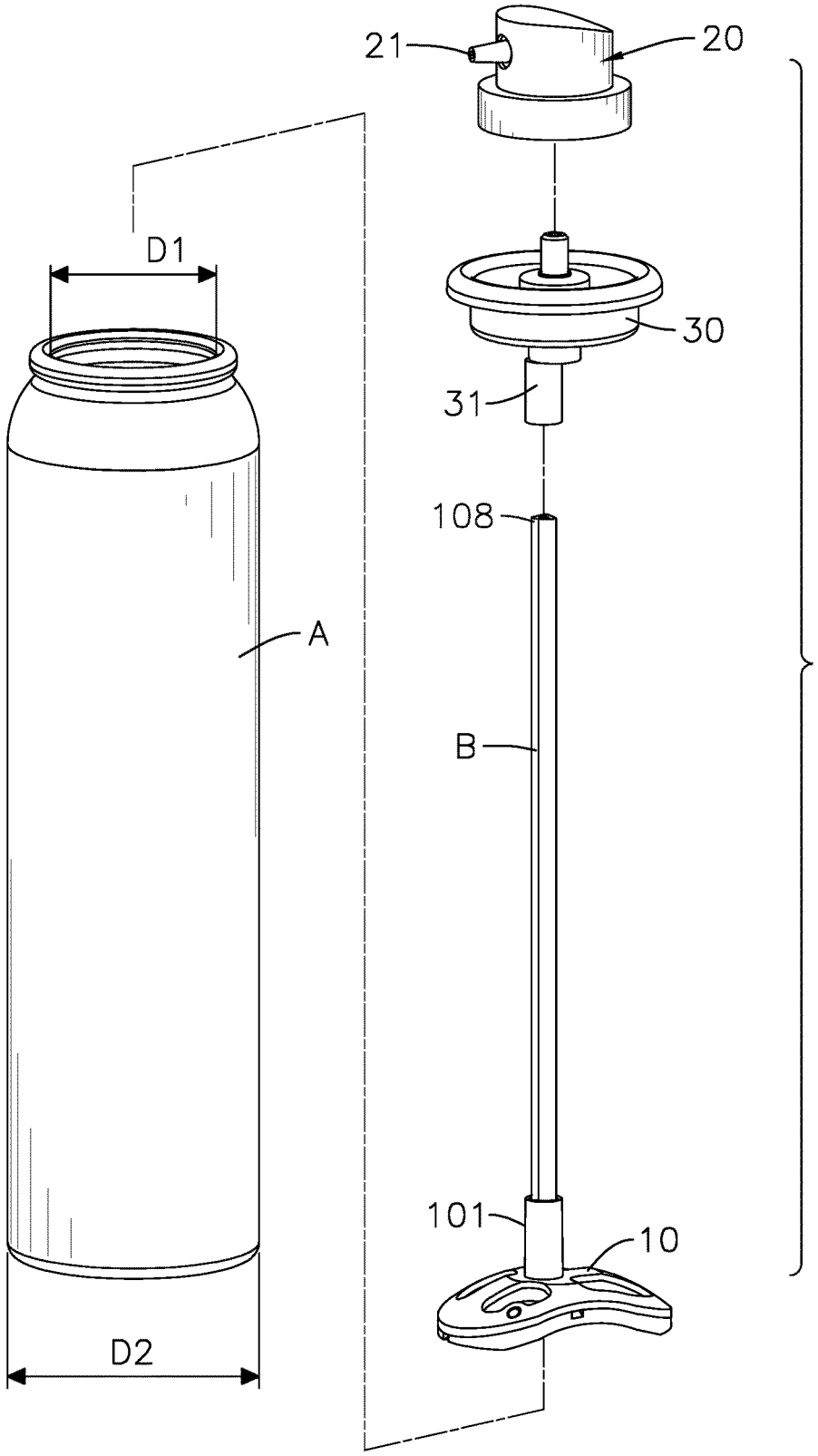
FIG. 1 is an exploded view of a first embodiment of an extending drawing unit in accordance with the present invention, showing the extending drawing unit mounted on a liquid dip tube and separated from a container body.
Figure 2:
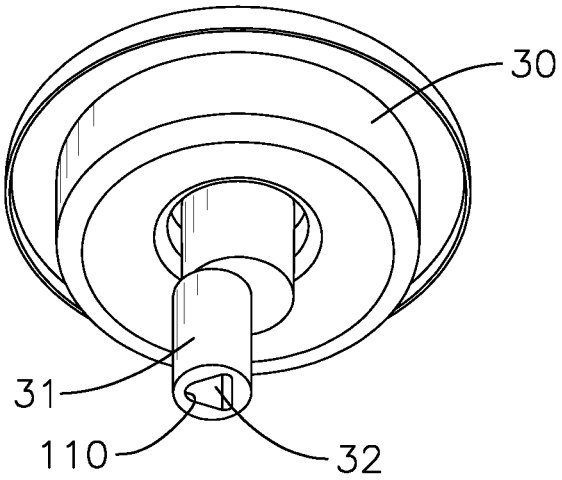
FIG. 2 is a bottom perspective view of the first embodiment of the extending drawing unit in FIG. 1, showing an aerosol valve.

With reference to FIGS. 1, 5, 13 and 15, an extending drawing unit of a liquid product container in accordance with the present invention is adapted to be mounted in a container body A, and is adapted to be connected to a liquid dip tube B. The liquid product container may be a spray can with high pressure gas or a water spray bottle that disperses liquid by pressurizing the air with normal pressure.

In the liquid product container of the present invention, the container body A is filled with liquid product C and propellant. When a user presses the actuator 20, a pressure of the propellant pushes the liquid product C to pass an aerosol valve 30 and then a spray nozzle 21 of the actuator 20 to be sprayed out. Preferably, the propellant is high pressure gas soluble in liquid product C such as environmental friendly refrigerant (HFO-1234yf) or dimethyl ether (DME). The liquid product C is formulated product content such as pepper spray or insecticide. But the configuration is not limited above, as the present invention can also be applied in a product without using high-pressure air, such as a press-type spray pump 33 for spraying alcohol sanitizer, a spray bottle for gardening, or any kind of bottle with a screwable bottle collar and a suction tube that uses uncompressed air as propulsion to spray out liquid via pressure and be also applied to any other mechanism besides the aerosol valve 30 or the press-type spray pump 33, that has a function of spraying or drawing liquid. Moreover, the extending drawing unit may be used with accessories with suction function, such as teats on baby bottle.

In a first embodiment, the aerosol valve 30 is conventional and will not be detailed below. Two regular specifications of the aerosol valve 30 are 1 inch (large volume size) and 20 mm (small volume size).

Figure 5:
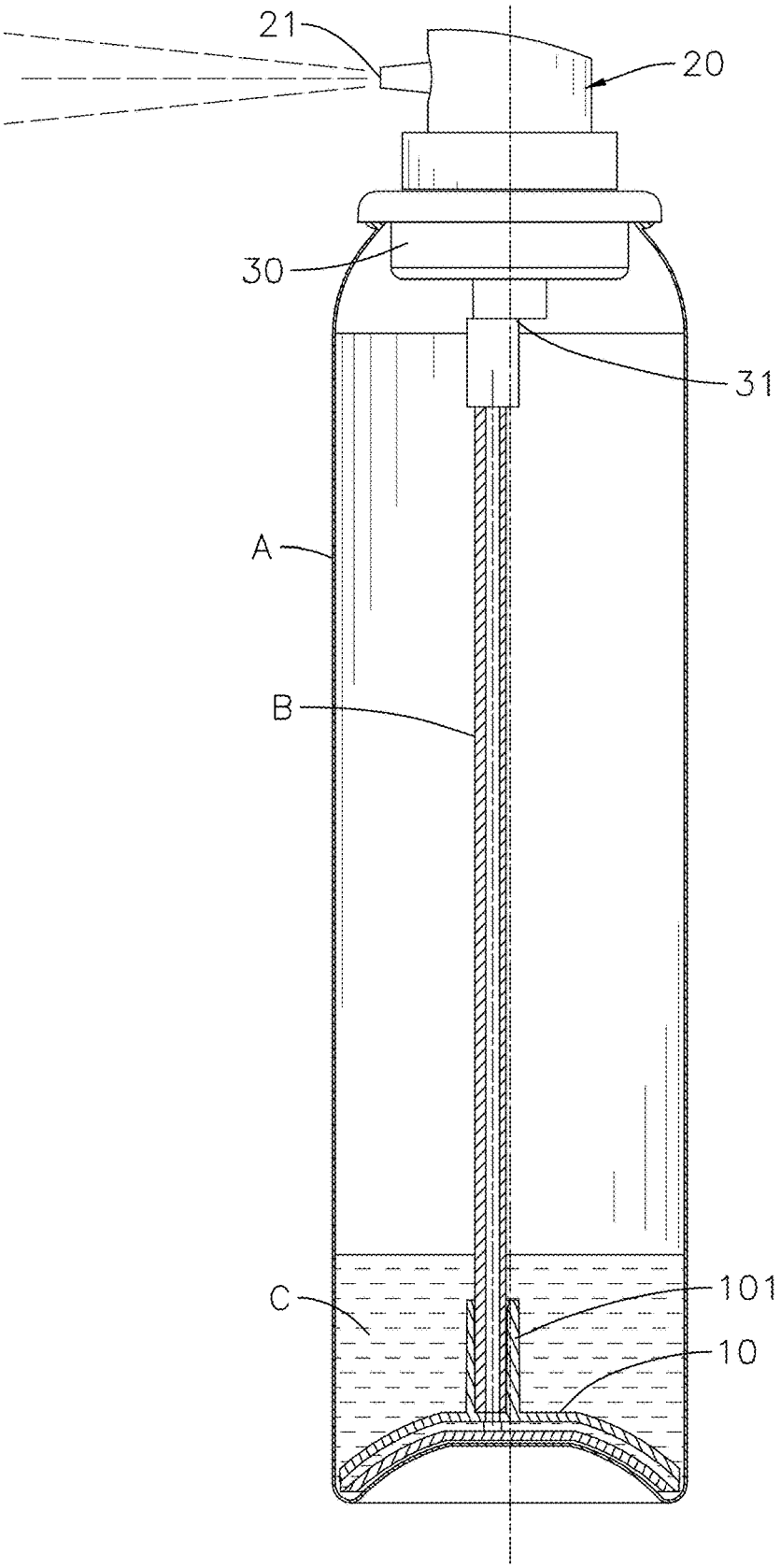
FIG. 5 is a side view in cross-section of the first embodiment of the extending drawing unit in FIG. 1, showing the extending drawing unit mounted on the liquid dip tube and located in the container body.

In the first embodiment, with reference to FIGS. 1 and 5, the container body A is a large volume size one and is made of metal. An outer diameter D2 of the container body A is 38 mm. The aerosol valve 30 that is used with the container body A is 25.4 mm (1 inch), and an inner diameter D1 of an opening of the container body A is also 25.4 mm (1 inch). But the specification is not limited thereto. In the first embodiment, the aerosol valve 30 may also be 20 mm and used with the metal container body A having the outer diameter D2 of 25 mm In the first embodiment, with reference to FIGS. 5 to 9, the extending drawing unit has the liquid dip tube B and a main body 10. The main body 10 is mounted in the container body A and extends to a bottom edge defined inside the container body A. The main body 10 has multiple extending liquid drawing passages 11 formed inside the main body 10. Each one of the extending liquid drawing passages 11 extending along a respective one of radial directions of the container body A. The extending liquid drawing passages 11 respectively form multiple extending liquid drawing openings 12 on an annular side surface of the main body 10. The extending liquid drawing openings 12 are arranged annularly, are spaced apart from each other, and are located in the bottom edge of the container body A. The main body 10 has a connecting port segment 101 connected to the extending liquid drawing passages 11 and connected to the liquid dip tube B, such that the liquid dip tube B is connected to the extending liquid drawing openings 12.

Figure 3:
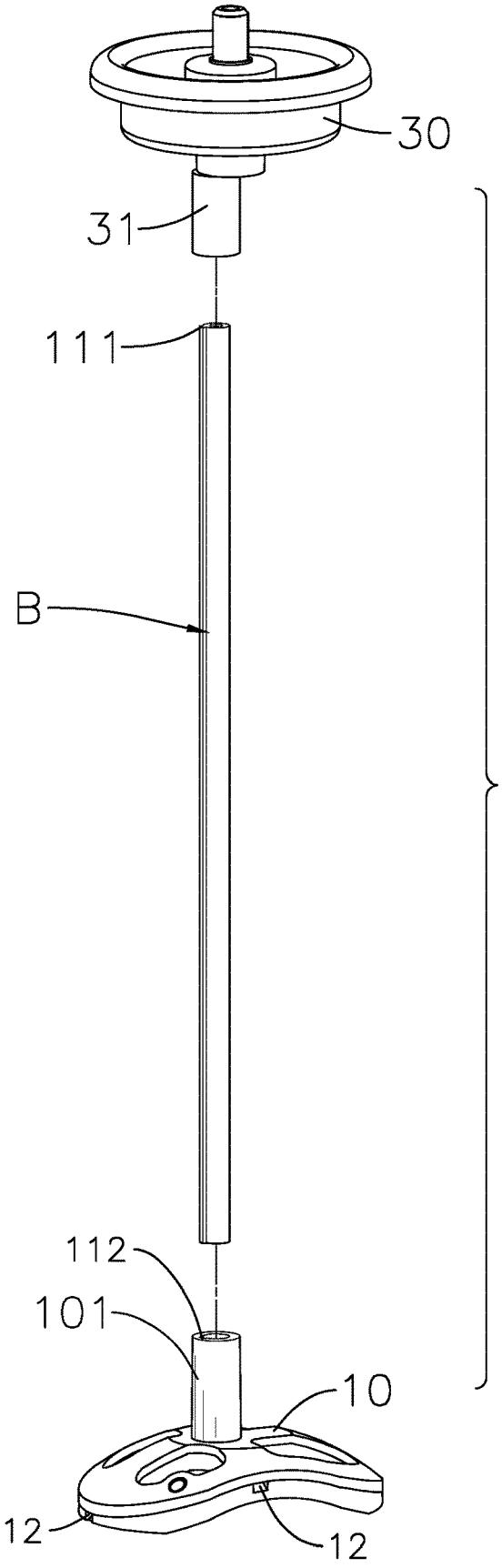
FIG. 3 is a exploded perspective view of another embodiment of the extending drawing unit in accordance with the present invention, showing the liquid dip tube, the aerosol valve, and the extending drawing unit.

Specifically, in the first embodiment, with reference to FIG. 3, the main body 10 is a board. The extending liquid drawing openings 12 are formed on an annular surface of the board. The connecting port segment 101 is located on a top side surface of the board. The annular surface of the board is connected to an edge of the side surface of the board and extends along the edge of the side surface of the board.

Figure 7:
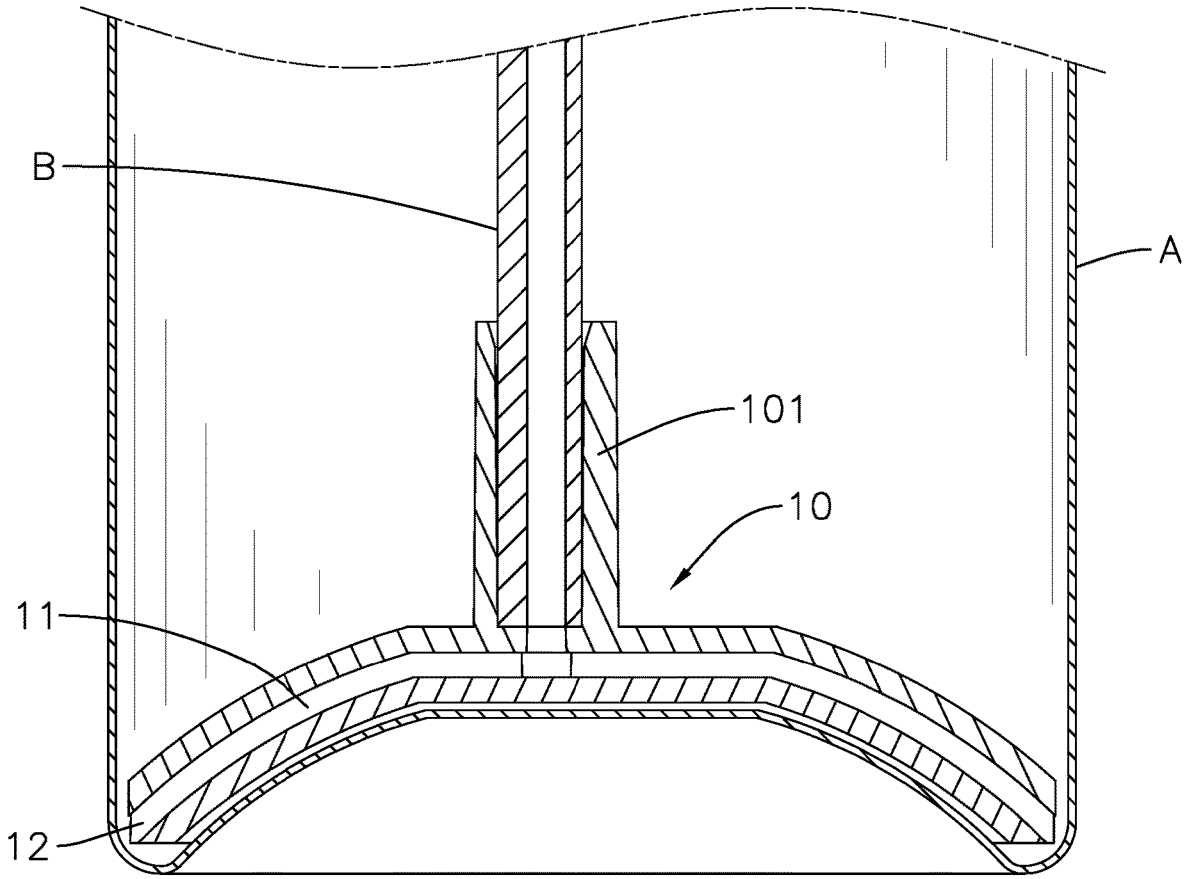
FIG. 7 is a partially enlarged view of the first embodiment of the extending drawing unit in FIG. 5.
Figure 8:
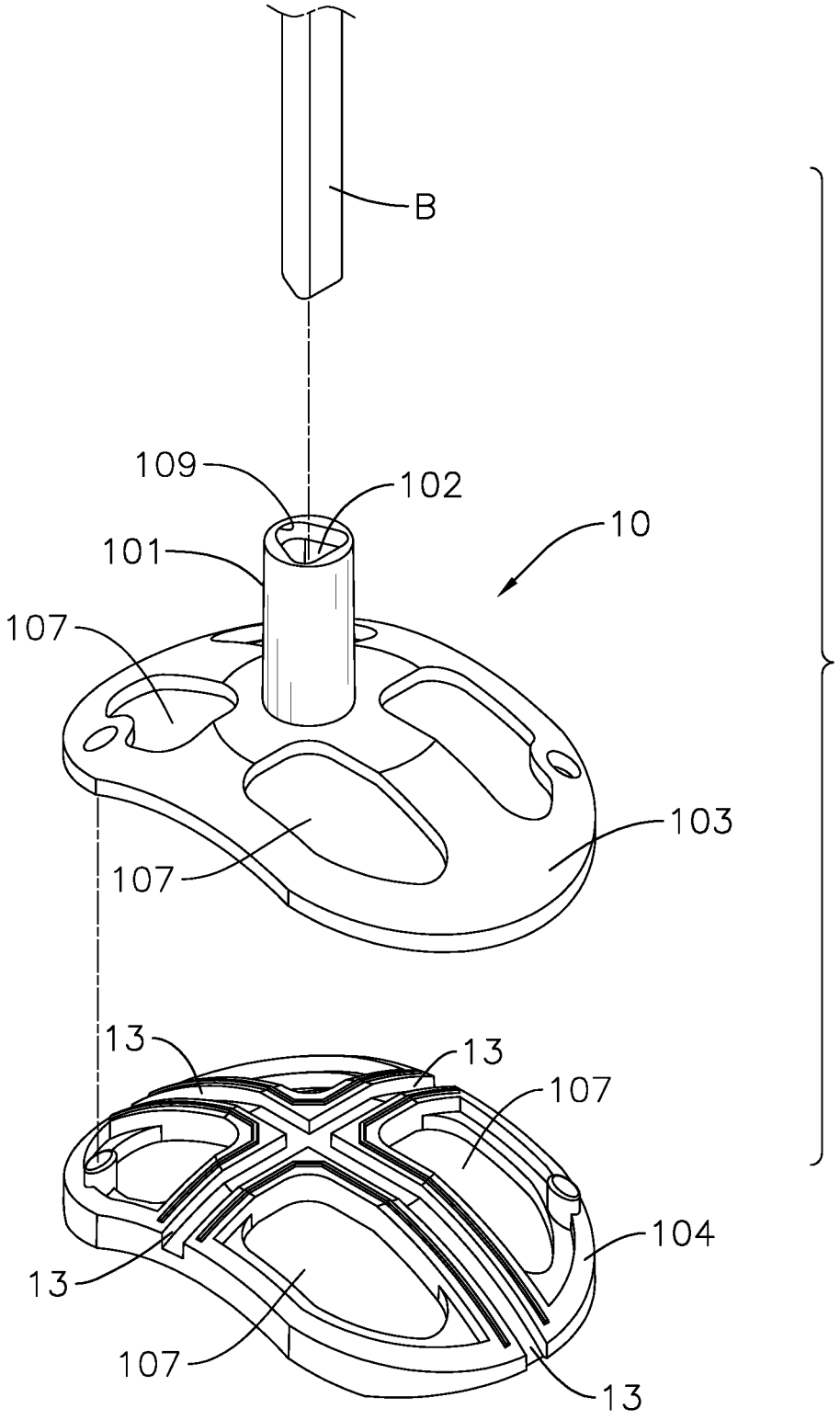
FIG. 8 is still another exploded top perspective view of the first embodiment of the extending drawing unit in FIG. 1, showing an upper segment and a lower segment.

Further, in the first embodiment, with reference to FIGS. 7 and 8, an amount of the extending liquid drawing passages 11 is four. The four extending liquid drawing passages 11 are arranged as a cross and respectively extend to a front side, a rear side, a left side, and a right side of the bottom edge of the container body A.

Figure 9:
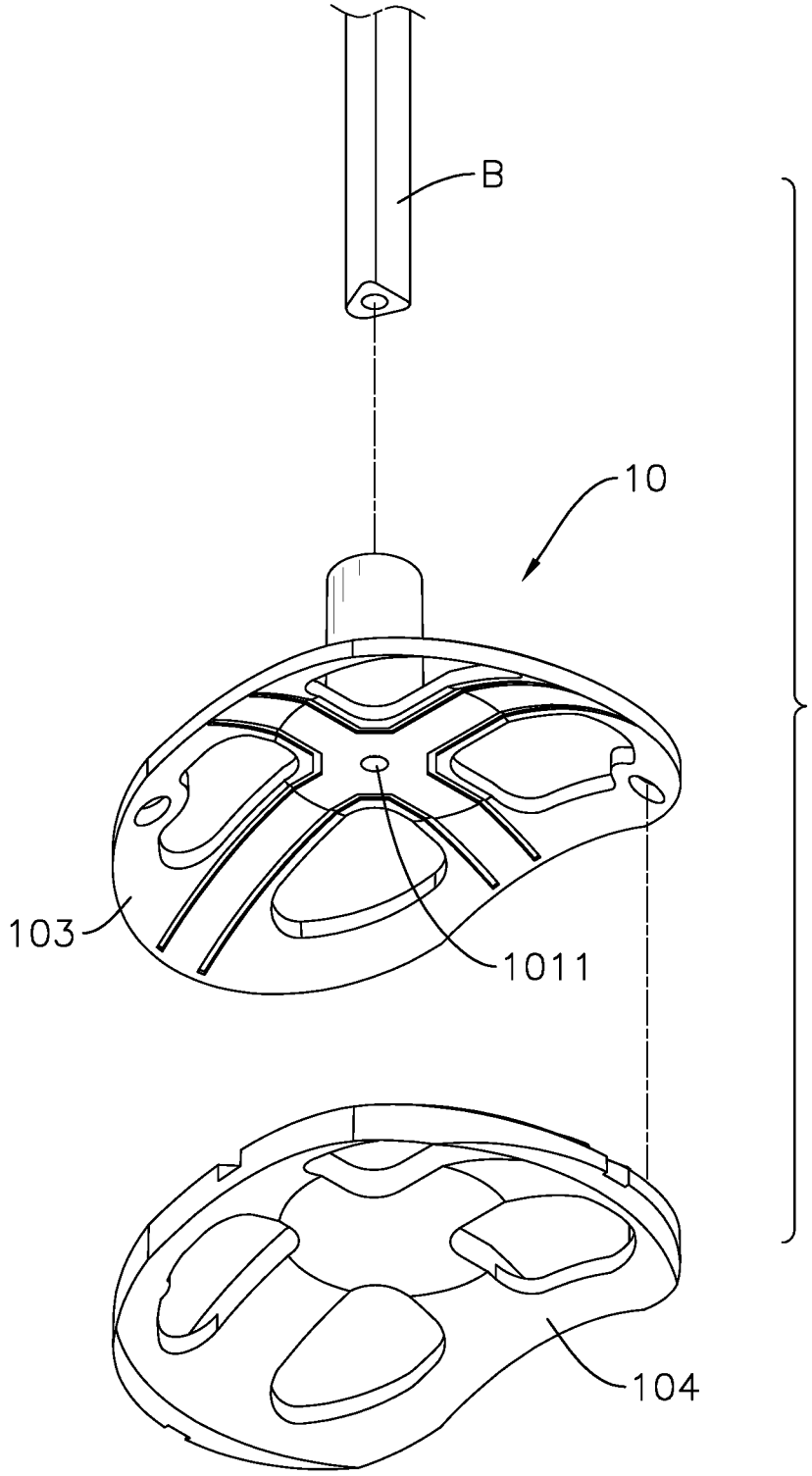
FIG. 9 is still another exploded bottom perspective view of the first embodiment of the extending drawing unit in FIG. 1, showing the upper segment and the lower segment.

Besides, with reference to FIGS. 7, 8, and 9, in the first embodiment, the main body 10 has an upper segment 103 and a lower segment 104. The connecting port segment 101 is formed on the upper segment 103. The lower segment 104 is assembled with the upper segment 103 and is opposite to the connecting port segment 101. The extending liquid drawing passages 11 are formed between the upper segment 103 and the lower segment 104. The lower segment 104 has multiple grooves 13 formed on a top surface of the lower segment 104. The grooves 13 of the lower segment 104 are covered by a bottom surface of the upper segment 103 to form the extending liquid drawing passages 11.

Furthermore, the upper segment 103 forms the connecting port segment 101, and a confluence suction port 1011 is formed in an axial center of an inner hole 102 of the connecting port segment 101 and is formed through a bottom surface of the upper segment 103.

Furthermore, the extending liquid drawing passages 11 are formed between the upper segment 103 and the lower segment 104, and the confluence suction port 1011 is located above a cross-shaped confluence of the extending liquid drawing passages 11 and is connected to the extending liquid drawing passages 11. Specifically, the extending liquid drawing openings 12 are connected to the extending liquid drawing passages 11 and thus connected to the confluence suction port 1011, so the extending liquid drawing openings 12 are connected to the liquid dip tube B.

Besides, with reference to FIGS. 7, 8, and 9, in the first embodiment, a bottom surface of the main body 10 concaves and faces toward a bump on a bottom of the container body A. In the first embodiment, since the container body A is a large volume size can and thus has to sustain a large pressure of high pressure gas, a bottom wall of the container body A is configured concaving inward to sustain the large pressure. Therefore, making the bottom surface of the main body 10 concave allows the main body 10 to approach the bumping bottom wall of the container body A closer and to extend to a bottom corner where an annular wall and the bottom wall of the container body A.

Figure 10:
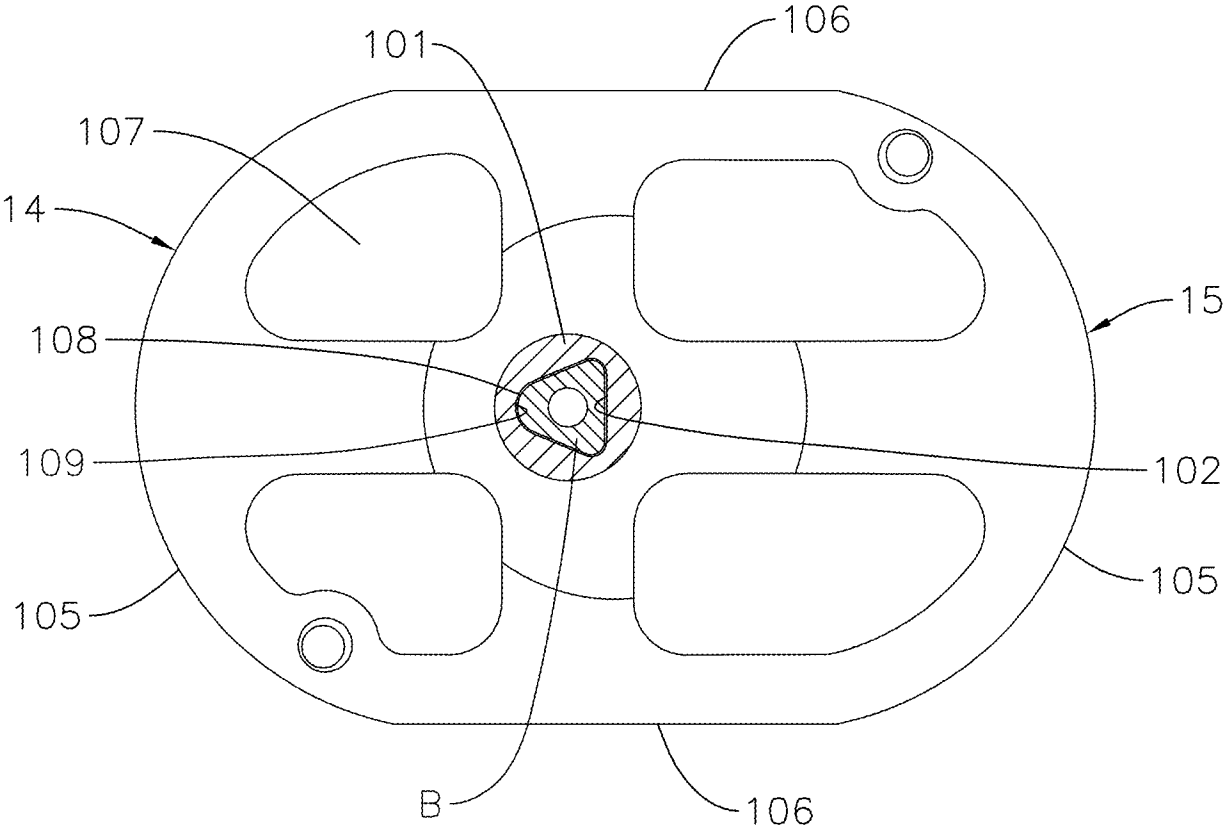
FIG. 10 is a top view in cross-section of the first embodiment of the extending drawing unit in FIG. 1, showing the extending drawing unit mounted on the liquid dip tube.
Figure 11:
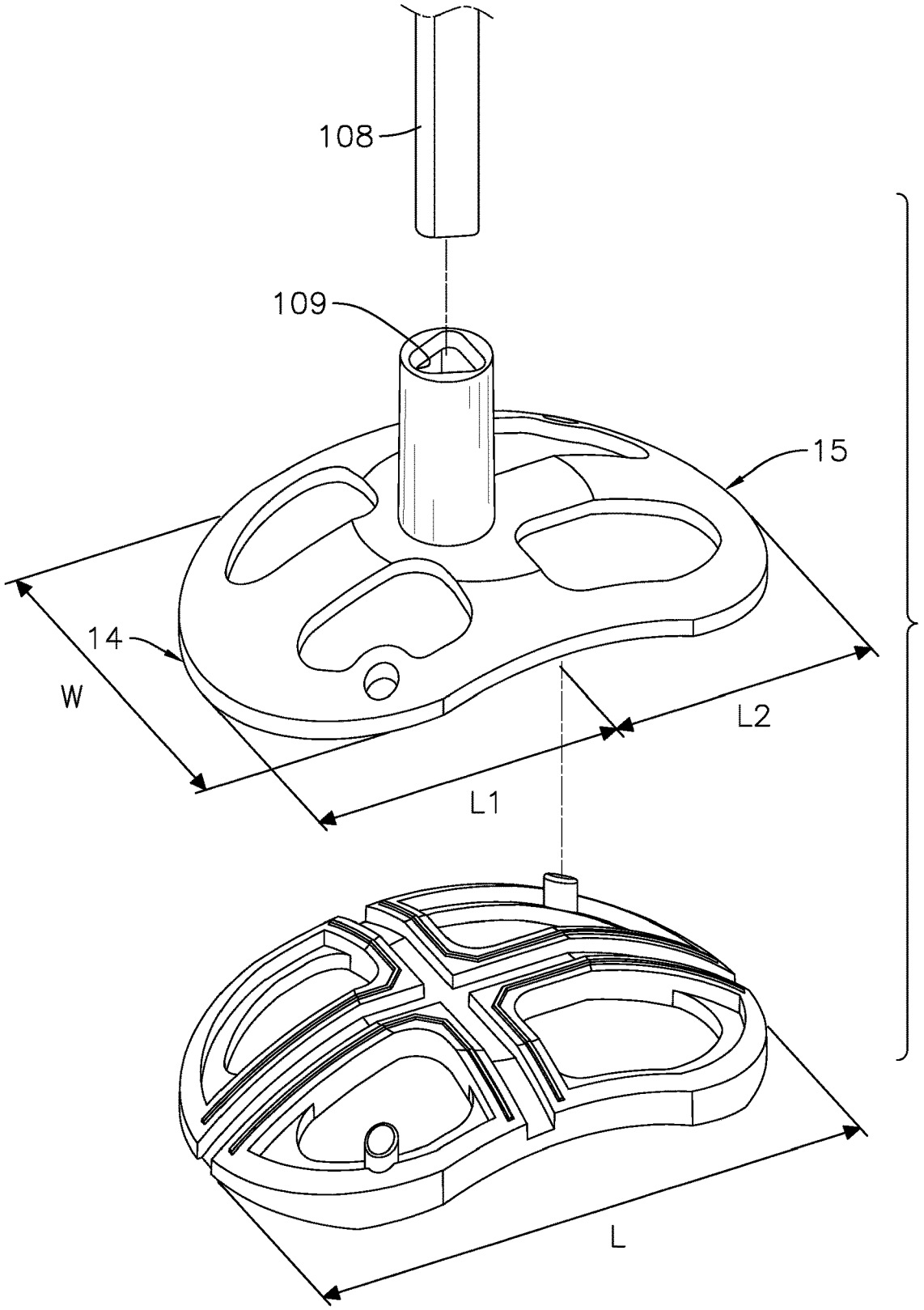
FIG. 11 is still another exploded top perspective view of the first embodiment of the extending drawing unit in FIG. 1, showing dimensions of the upper segment and the lower segment.
Figure 12A:
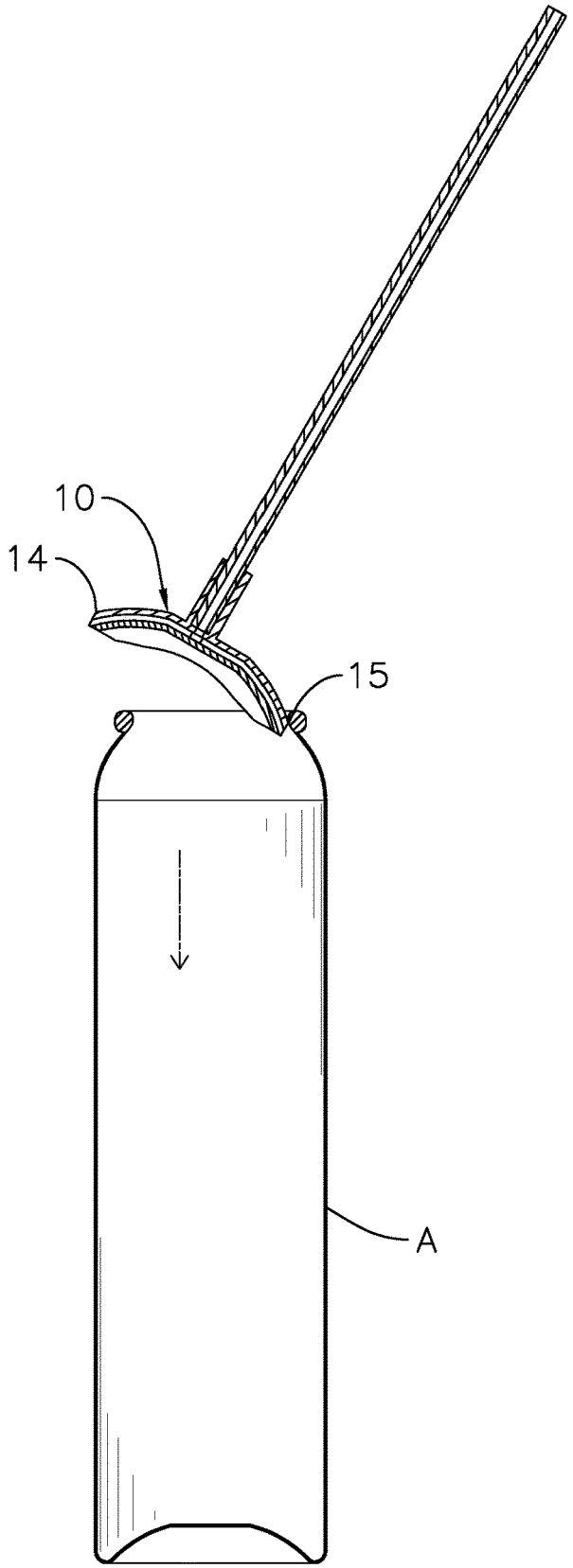
FIGS. 12A to 12E are operational views of the first embodiment of the extending drawing unit in FIG. 1, showing steps of a main body moved into the container body.
Figure 12B:
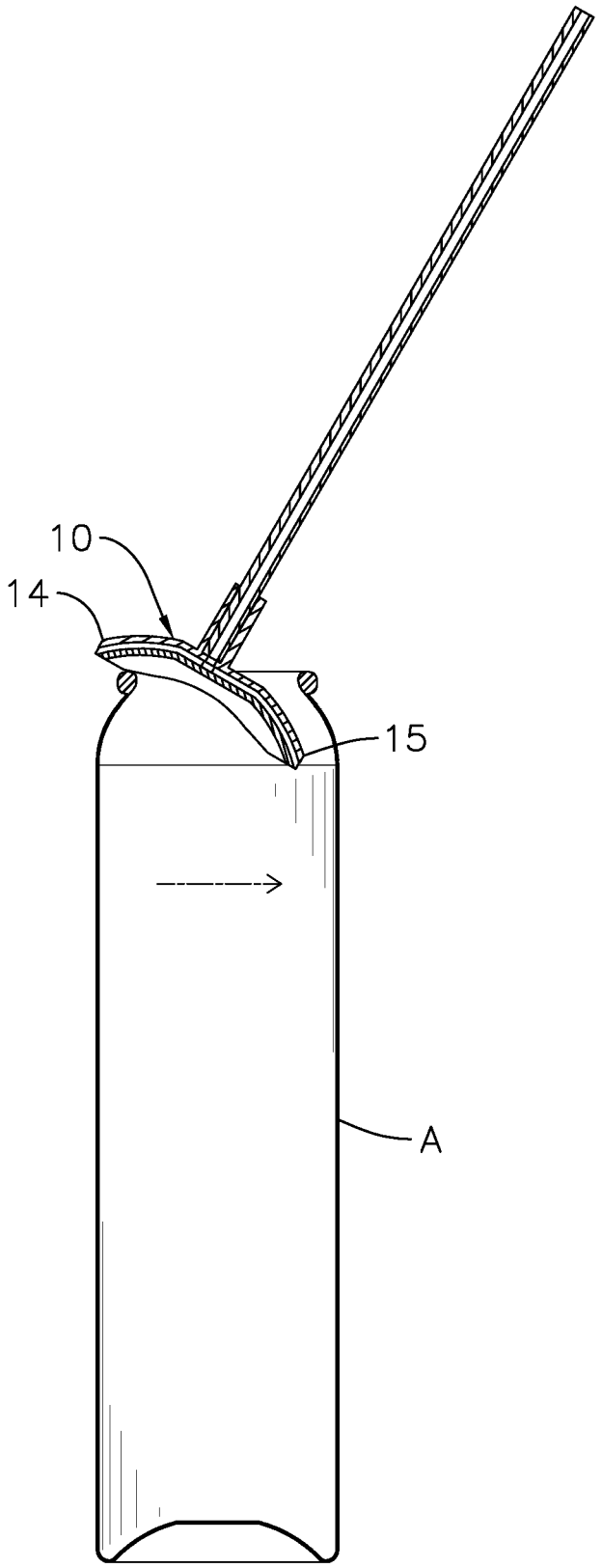
Figure 12C:
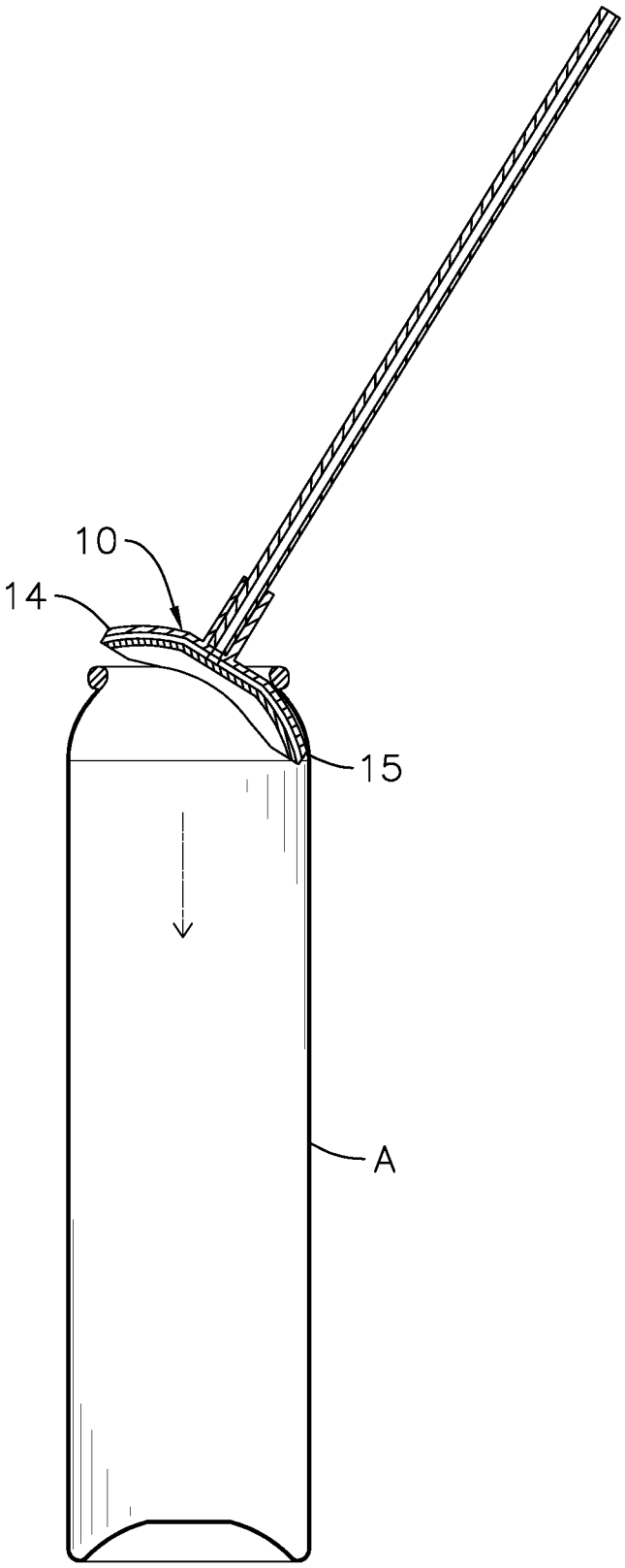
Figure 12D:
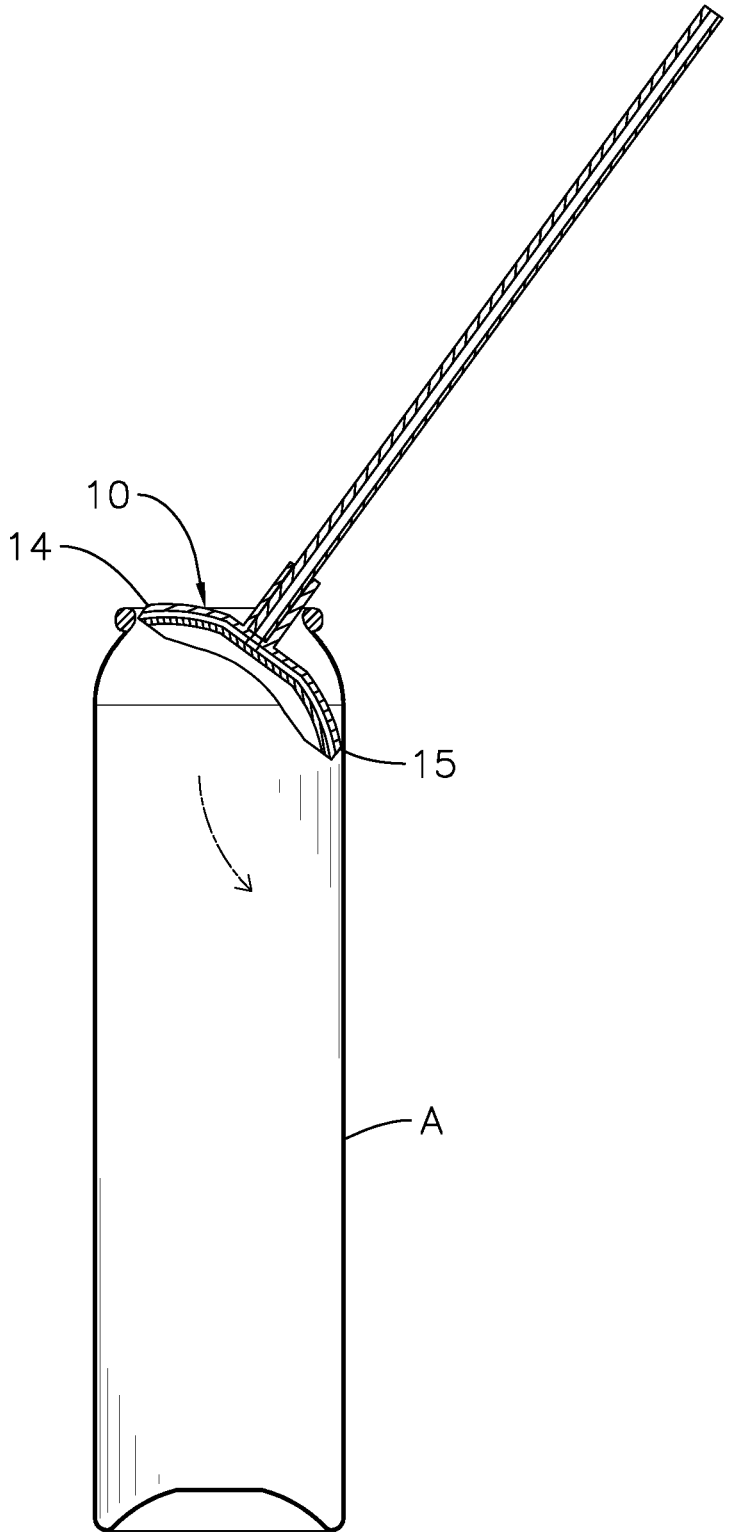
Figure 12E:
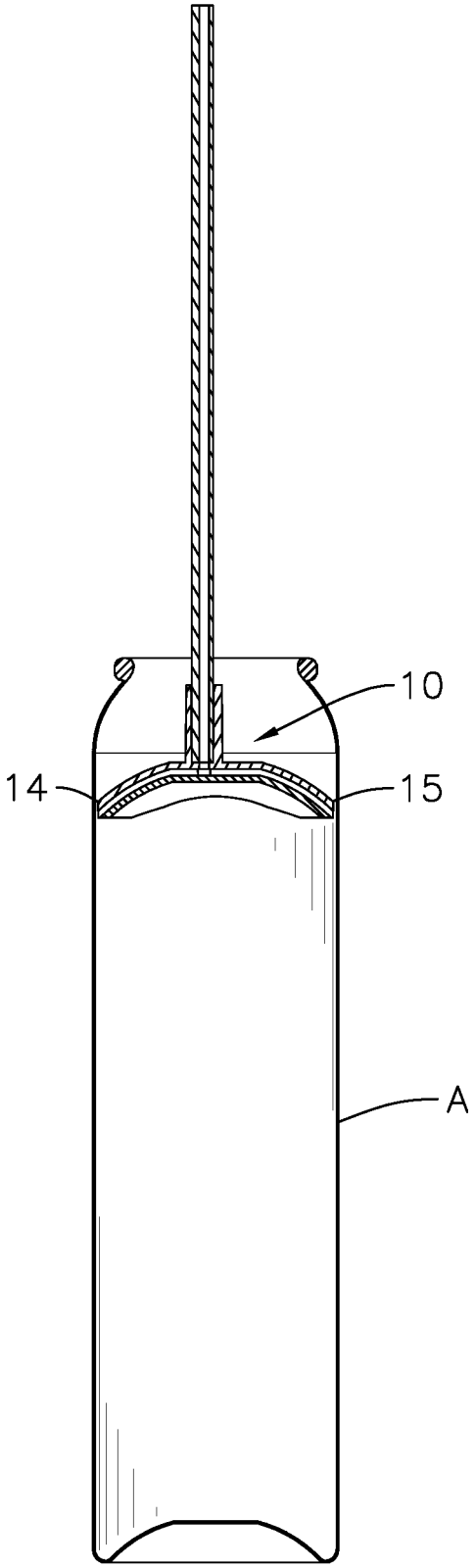
Figure 13:
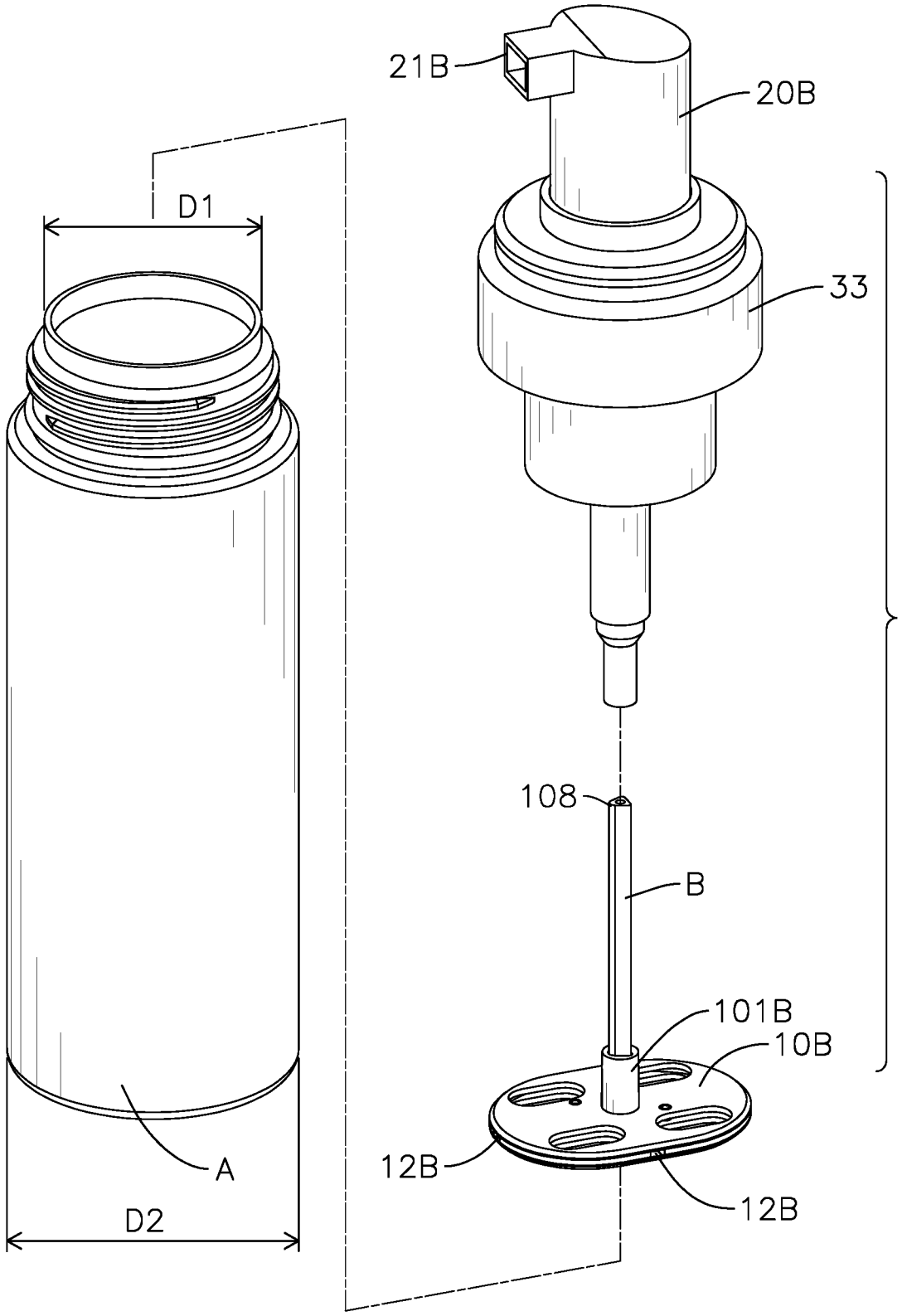
FIG. 13 is an exploded perspective view of a second embodiment of an extending drawing unit in accordance with the present invention, showing the extending drawing unit mounted on a liquid dip tube and separated from a container body.
Figure 14:
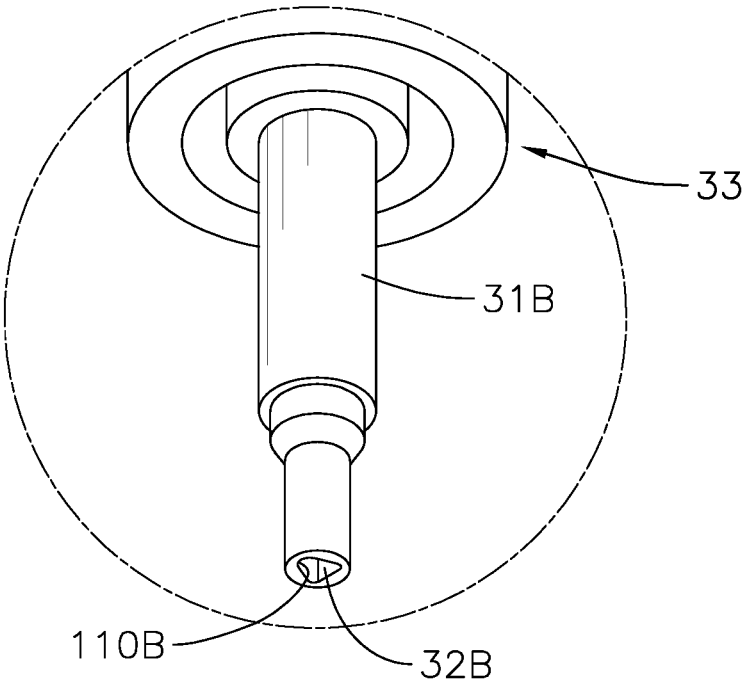
FIG. 14 is a bottom perspective view of the second embodiment of the extending drawing unit in FIG. 13, showing a spray pump.
Figure 15:
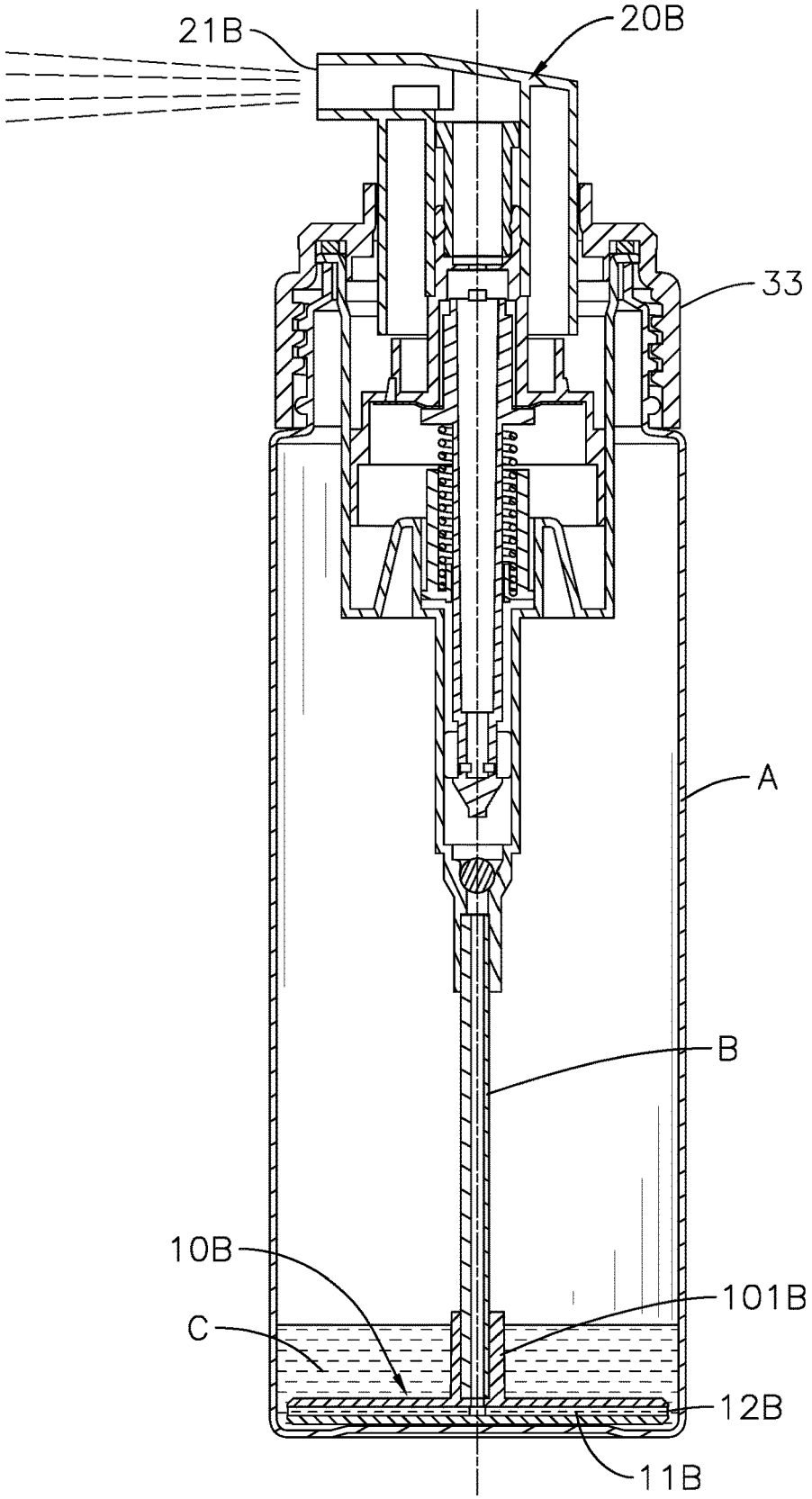
FIG. 15 is a side view in cross-section of the second embodiment of the extending drawing unit in FIG. 13.
Figure 16:
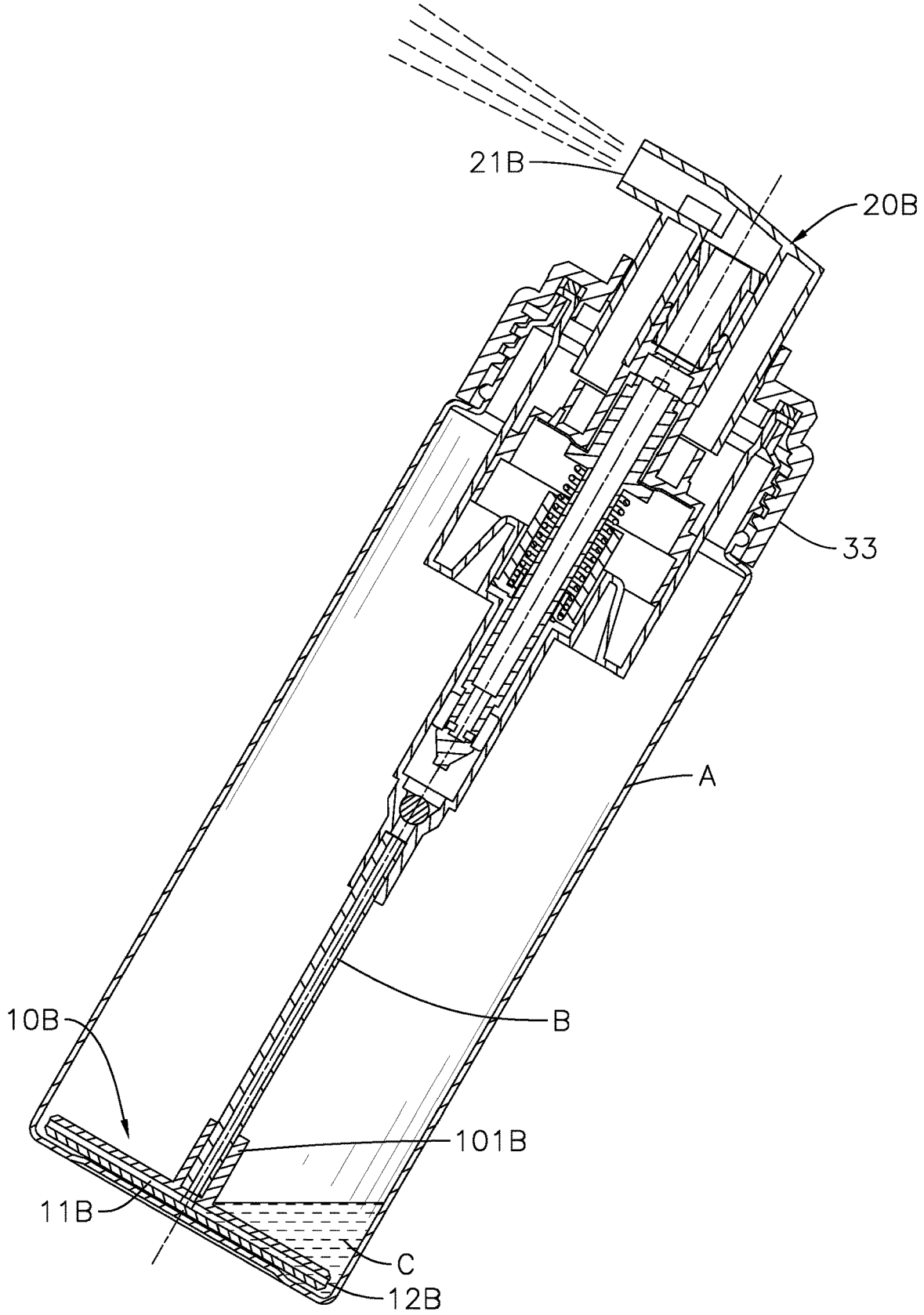
FIG. 16 is a side view in cross-section of the second embodiment of the extending drawing unit in FIG. 13, showing the container body inclined.
Figure 17:
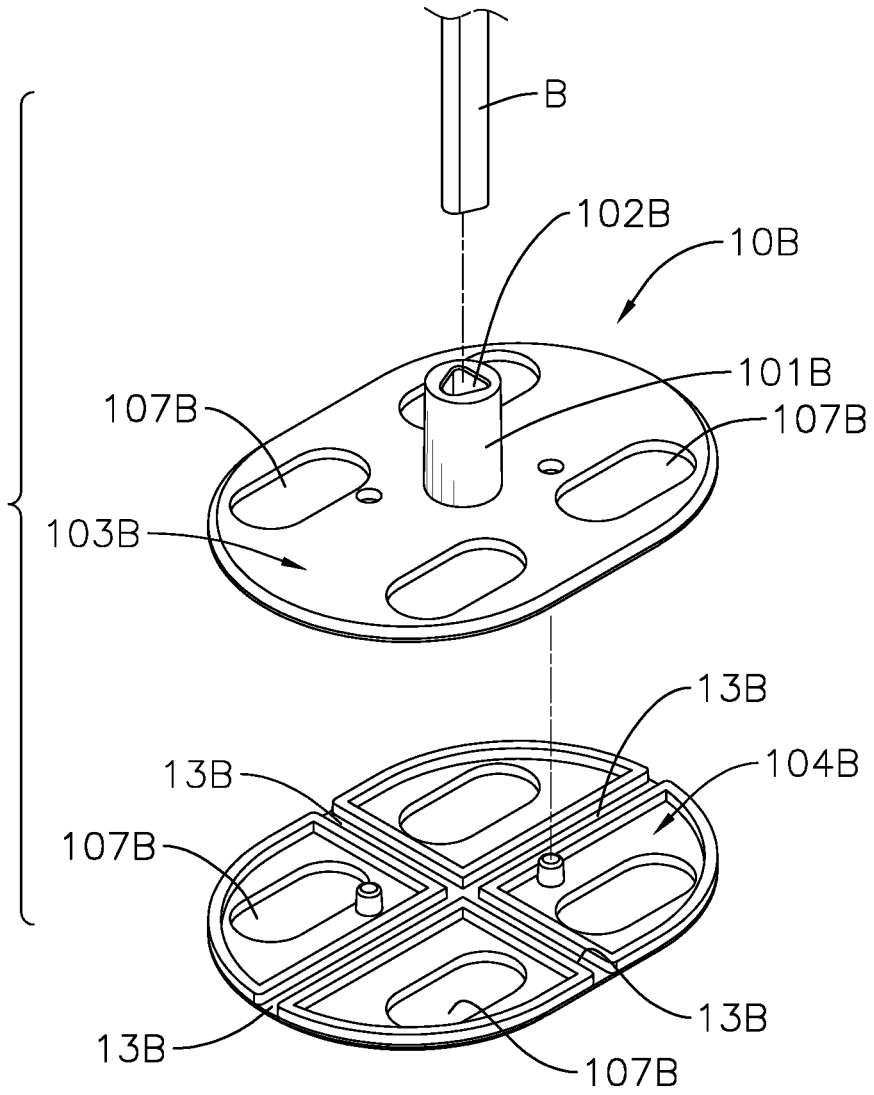
FIG. 17 is another exploded top perspective view of the second embodiment of the extending drawing unit in FIG. 13, showing the liquid dip tube, an upper segment, and a lower segment.
Figure 18:
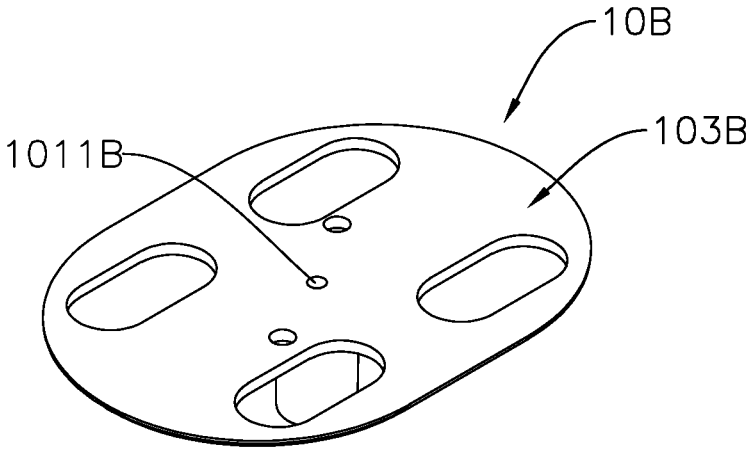
FIG. 18 is another perspective view of the second embodiment of the extending drawing unit in FIG. 13, showing a bottom side of the upper segment.
Figure 19:
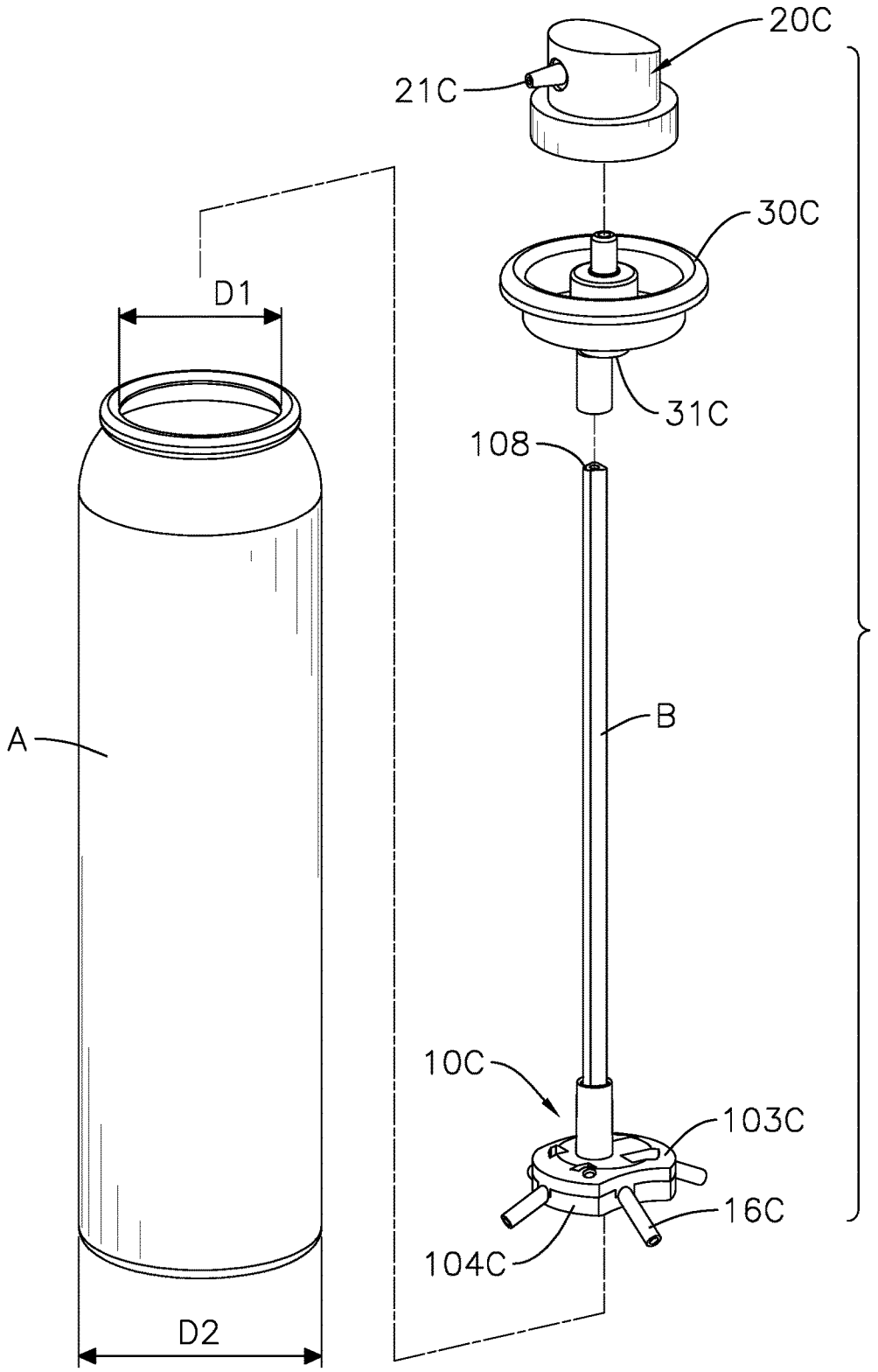
FIG. 19 is an exploded perspective view of a third embodiment of an extending drawing unit in accordance with the present invention, showing the extending drawing unit mounted on a liquid dip tube and separated from a container body.
Figure 20:
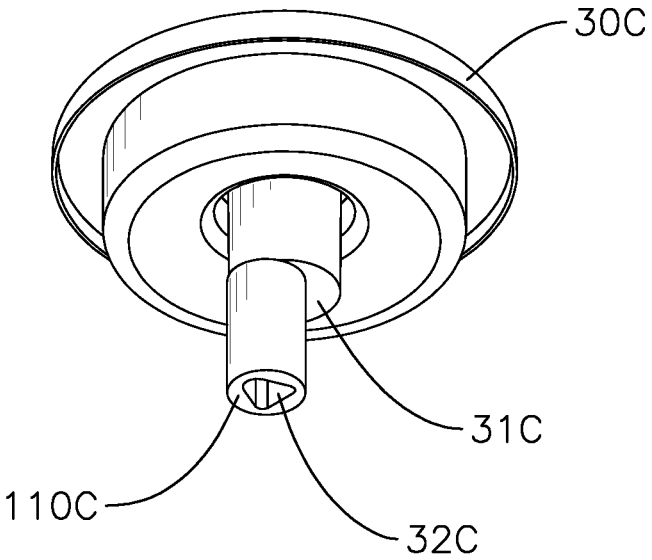
FIG. 20 is a bottom perspective view of the third embodiment of the extending drawing unit in FIG. 19, showing an aerosol valve.
Figure 21:
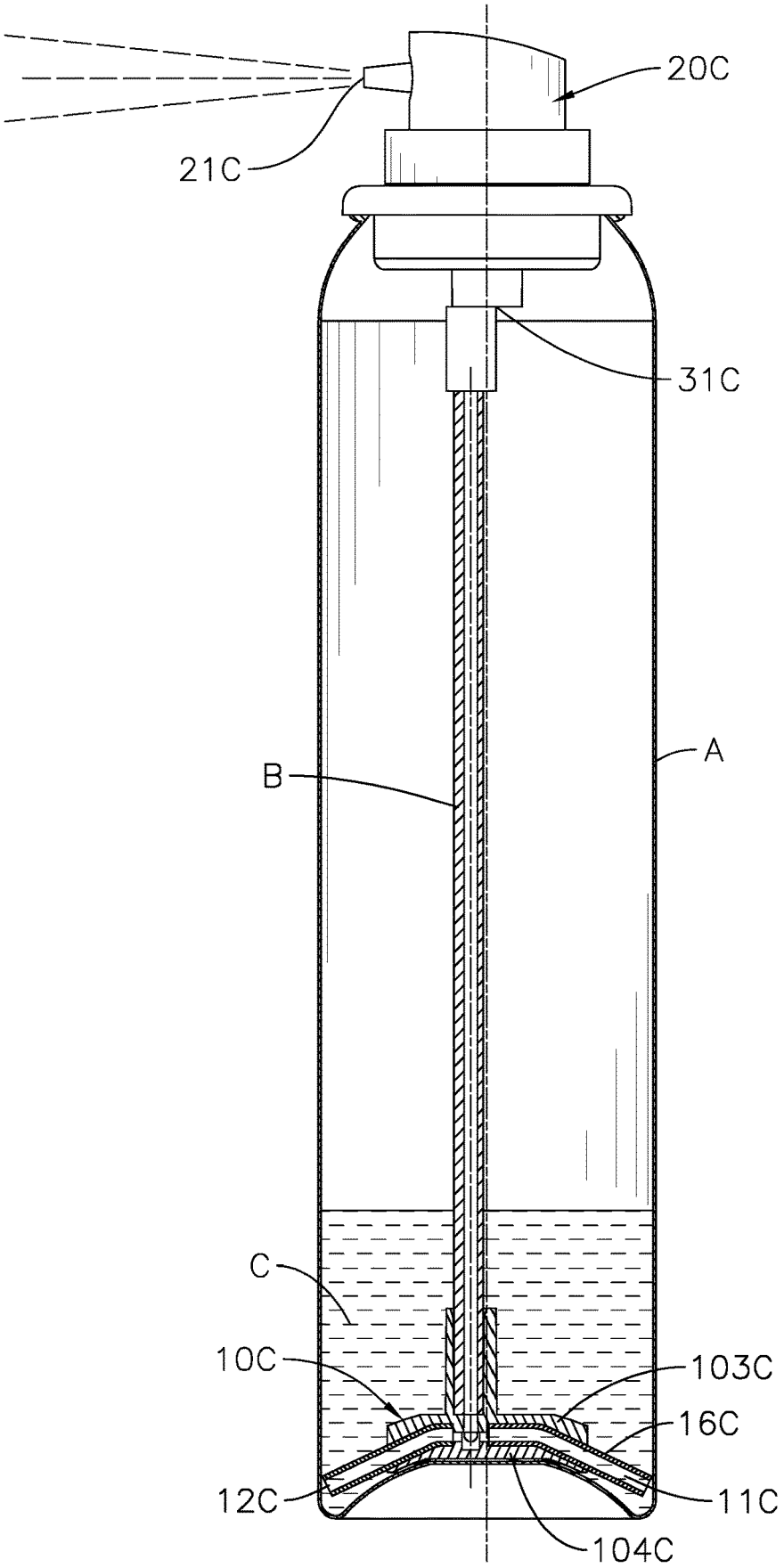
FIG. 21 is a side view in cross-section of the third embodiment of the extending drawing unit in FIG. 19, showing the extending drawing unit mounted on the liquid dip tube and located in the container body.
Figure 22:
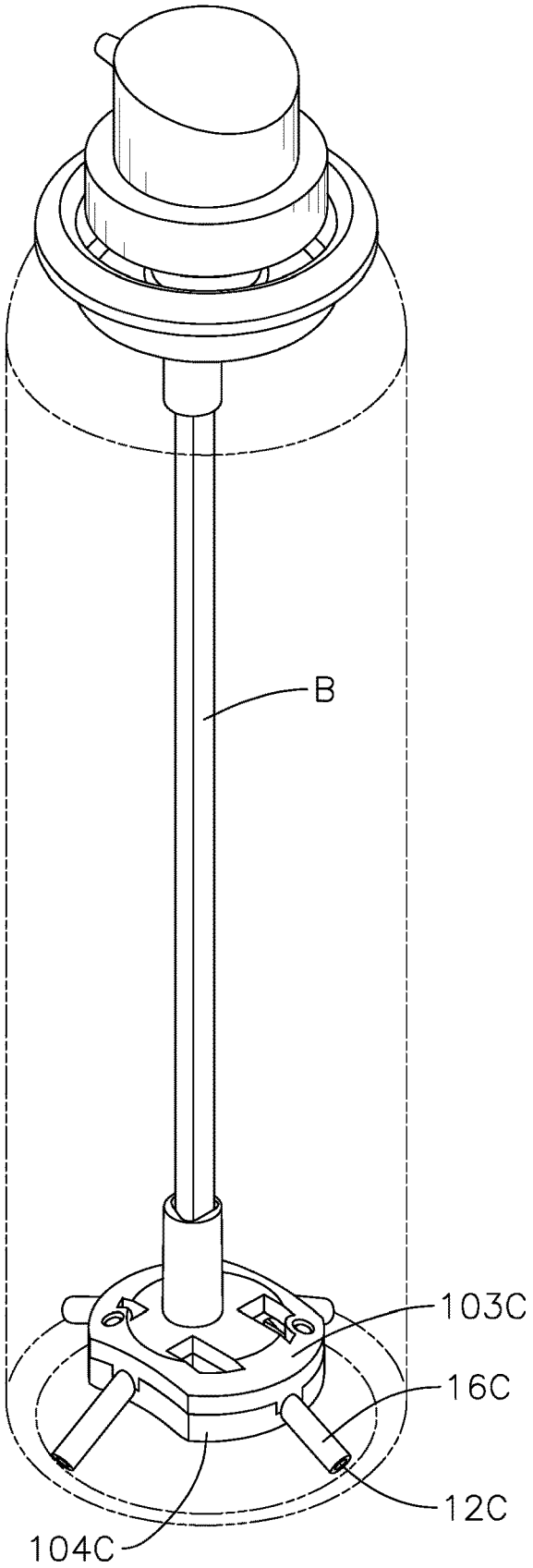
FIG. 22 is another perspective view of the third embodiment of the extending drawing unit in FIG. 19, showing the extending drawing unit mounted on the liquid dip tube and located in the container body.
Figure 23A:
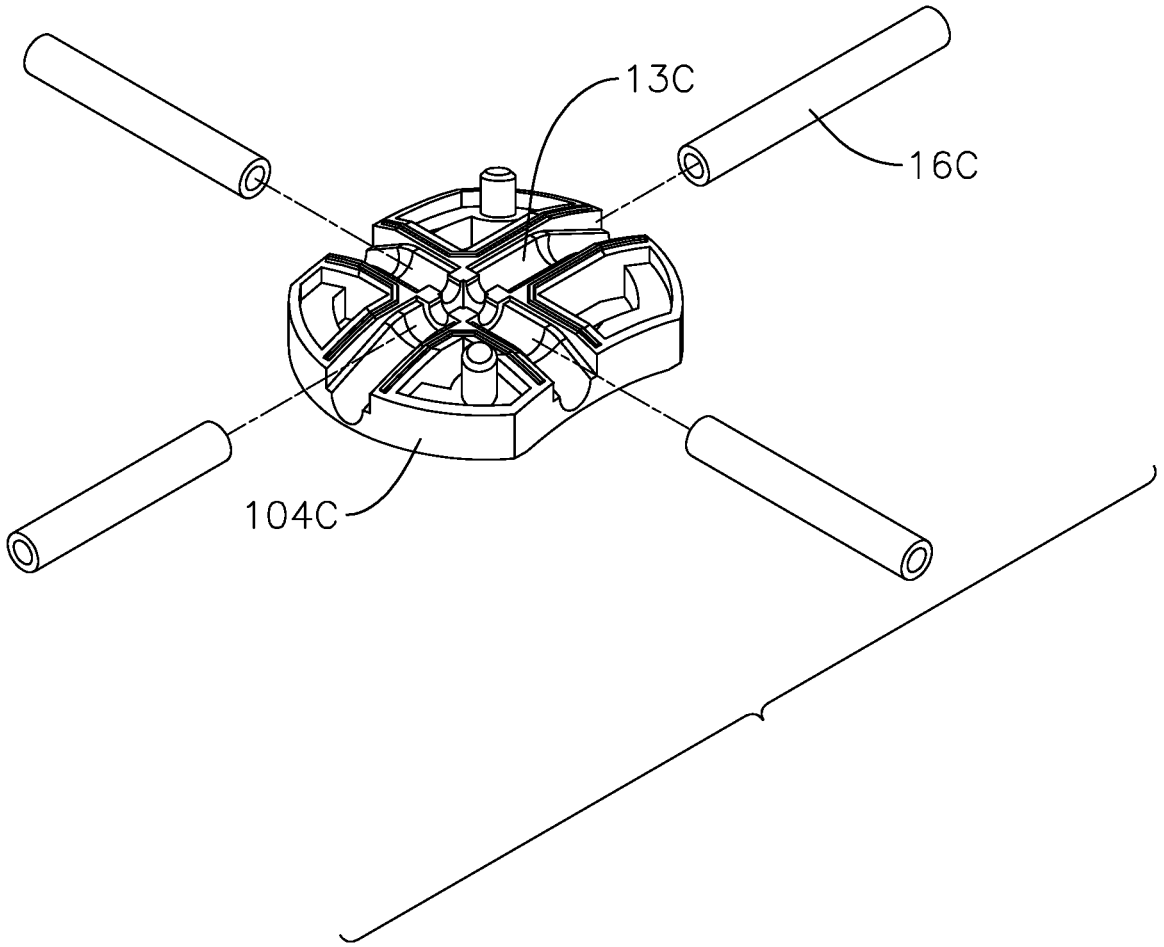
FIGS. 23A to 23C are operational views of the third embodiment of the extending drawing unit in FIG. 19, showing assembling steps of soft tubes and a lower segment.
Figure 23B:
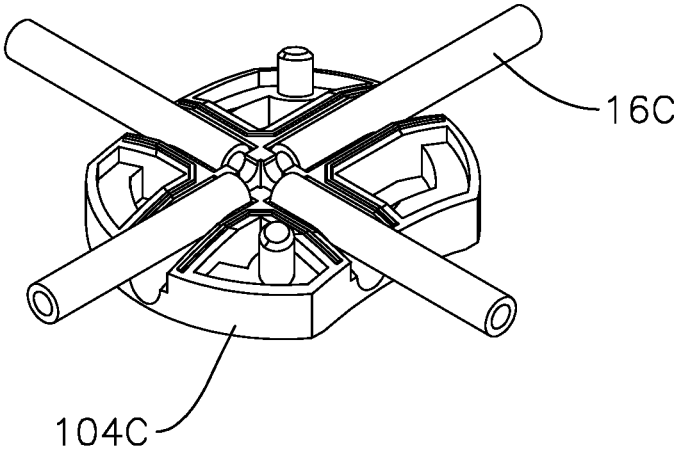
Figure 23C:
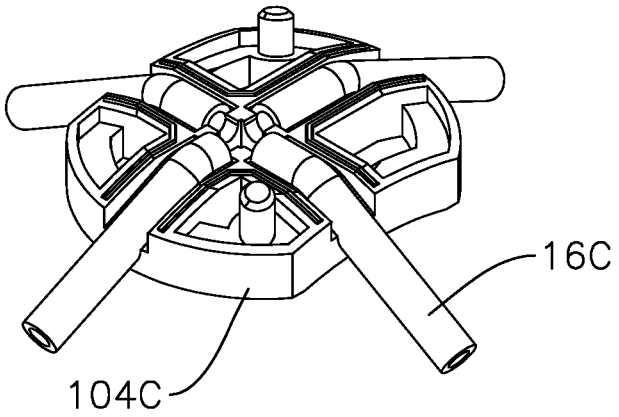
Figure 24:
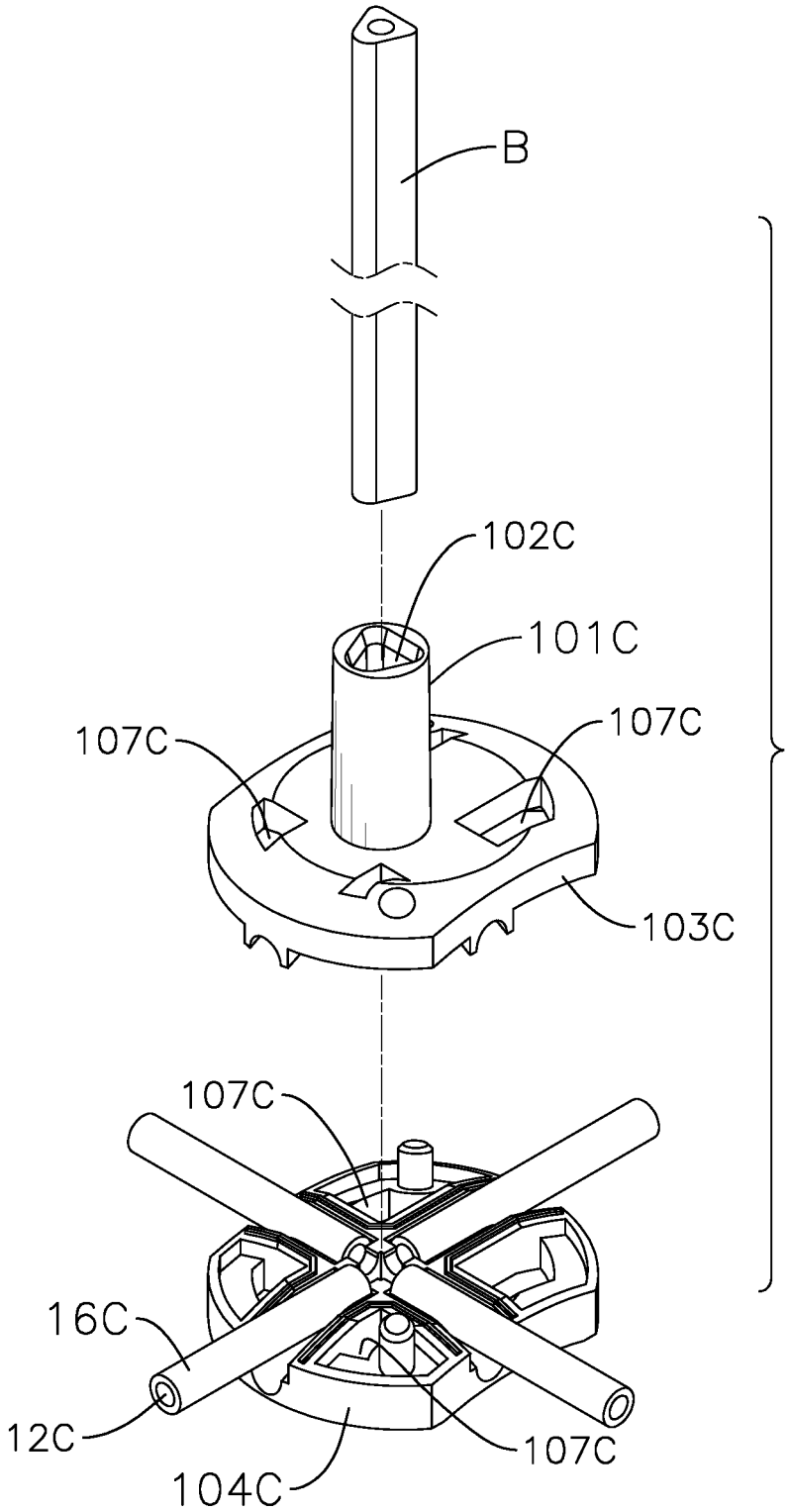
FIG. 24 is another exploded top perspective view of the third embodiment of the extending drawing unit in FIG. 19, showing the liquid dip tube, a upper segment, the soft tubes, and the lower segment.
Figure 25:
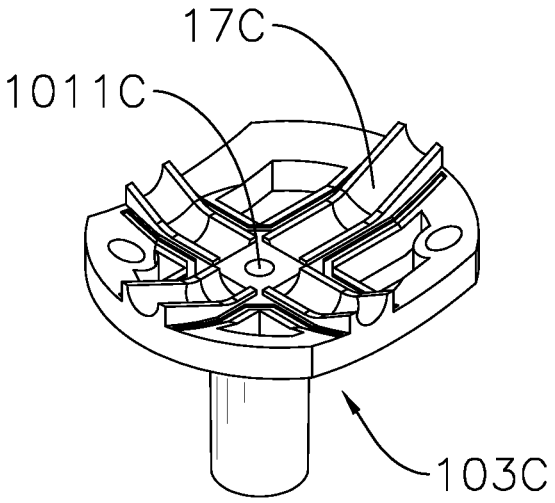
FIG. 25 is still another perspective view of the third embodiment of the extending drawing unit in FIG. 19, showing a bottom side of the lower segment.
Figure 26:
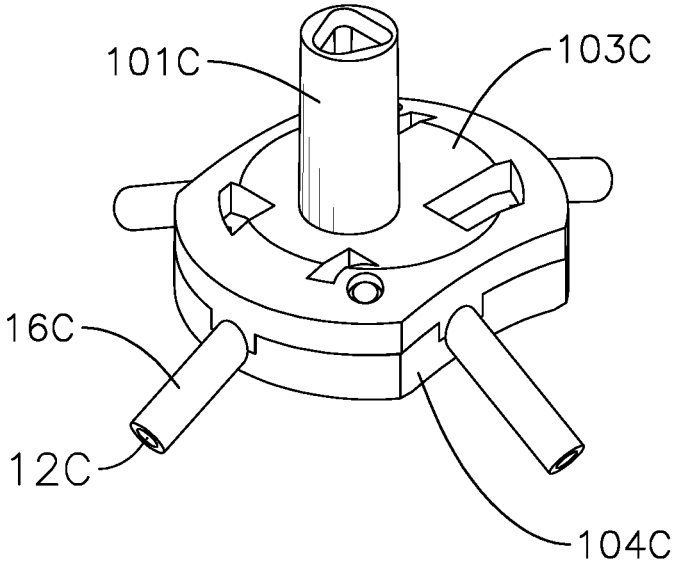
FIG. 26 is still another perspective view of the third embodiment of the extending drawing unit in FIG. 19, showing an assembly of the upper segment, the soft tubes, and the lower segment.
Figure 27:
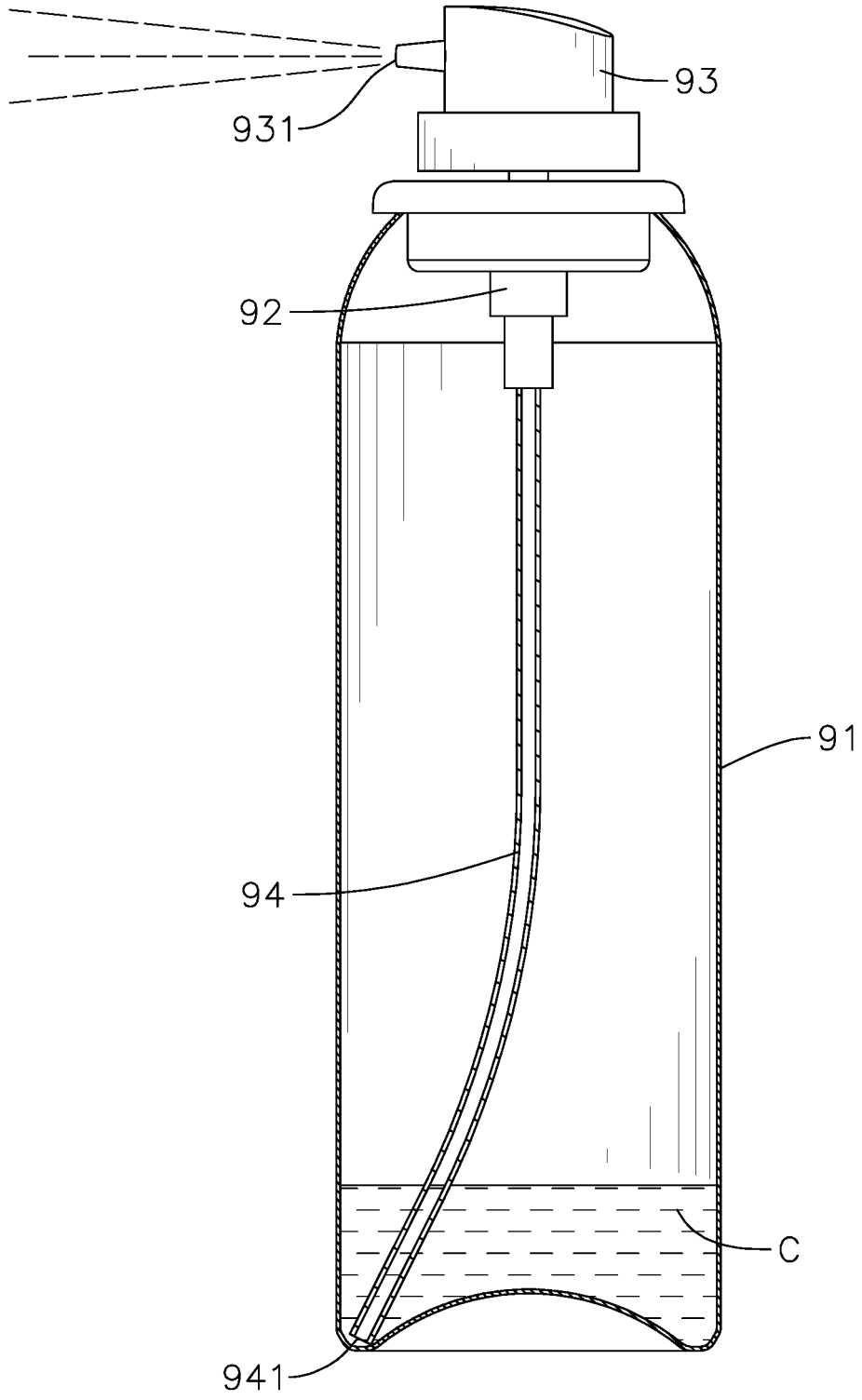
FIG.27 PRIOR ART
FIG. 27 is a side view in cross-section of a conventional liquid product container in accordance with the prior art, showing the liquid product container placed upright to spray.
Figure 28:
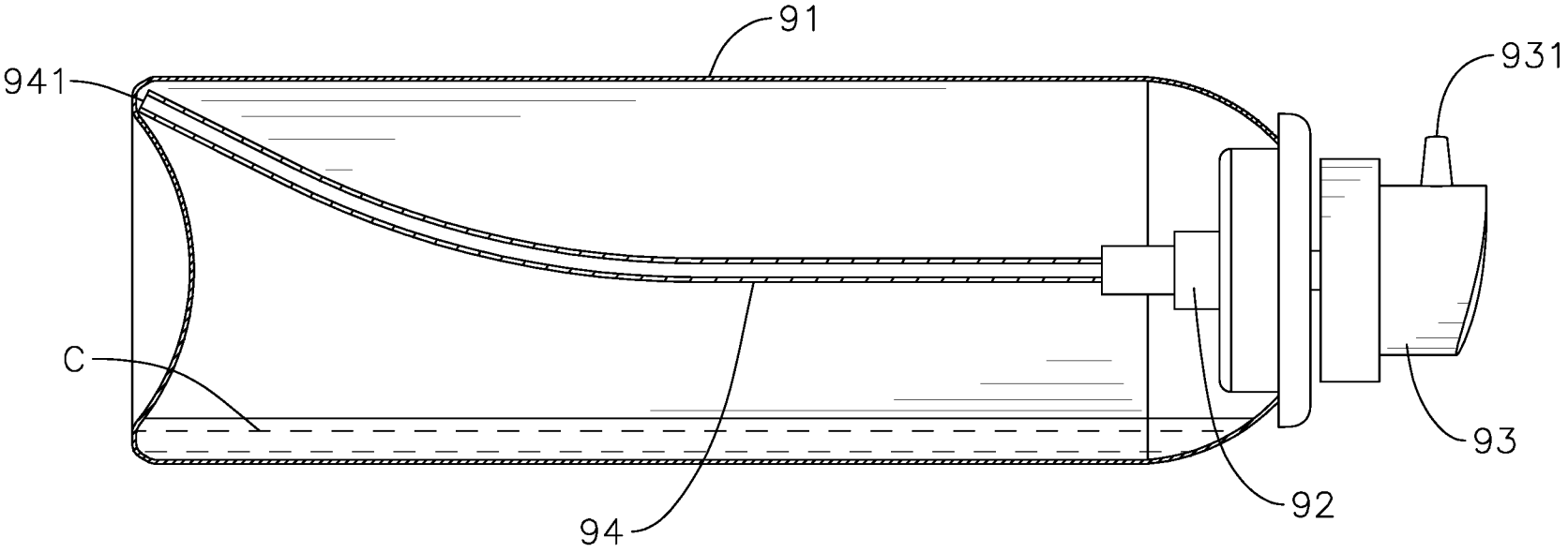
FIG. 28 PRIOR ART
FIG. 28 is a side view in cross-section of the conventional liquid product container in FIG. 27, showing the liquid product container placed horizontal to spray.

Additionally, with reference to FIGS. 1, 10, and 11, a cross-section shape of liquid dip tube B is an isosceles triangle, and one of three corners of the isosceles triangle is an arc corner 108 (R corner). The arc corner 108 (R corner) is configured for direction positioning.

With reference to FIGS. 1, 5, 8, 10, and 11, in the extending drawing unit of the liquid product container, the cross-section shape of the inner hole 102 of the connecting port segment 101 of the main body 10 is an isosceles triangle, and the cross-section shape of the inner hole 102 of the connecting port segment 101 is the same as the cross-section shape of the liquid dip tube B. One of three corners of the isosceles triangle is an arc corner 109 (R corner). The cross-section shape of the inner hole 102 of the connecting port segment 101 is an isosceles triangle, which is configured to engage with an isosceles triangle of a bottom end of the liquid dip tube B in cross-section. The arc corner 109 (R corner) is configured for direction positioning facing a first end 14 of the main body 10.

With reference to FIGS. 1, 2, 5 and 10, in the first embodiment, the aerosol valve 30 has a valve housing 31 mounted on a bottom of the aerosol valve 30. An inner hole 32 of a liquid product inlet on a bottom end of the valve housing 31 is an isosceles triangle in cross-section. One of three corners of the isosceles triangle is an arc corner 110 (R corner), and the arc corner 110 (R corner) and the spray nozzle 21 of the actuator 20 face toward a same direction. The inner hole 32, which is isosceles triangle in cross-section, of the liquid product inlet is configured to engage with a top end of the liquid dip tube B, which is also an isosceles triangle in cross-section. The arc corner 110 (R corner) and the spray nozzle 21 of actuator 20 are facing toward the same direction. Specifically, the main body 10 has the first end 14 and a second end 15, and the spray nozzle 21 of actuator 20 is facing toward the same direction of the first end 14.

With reference to FIGS. 1, 2, 5, 8, 10, and 11, in the first embodiment, a shape of liquid dip tube B on a cross-section perpendicular to an axial direction, a shape of the inner hole 102 of the connecting port segment 101, and a shape of the inner hole 32 of the liquid product inlet of valve housing 31 are of an identical isosceles triangle. The three identical isosceles triangles respectively have the arc corner 108 (R corner), the arc corner 109 (R corner), and the arc corner 110 (R corner). The arc corner 108 (R corner), the arc corner 109 (R corner), and the arc corner 110 (R corner) all face toward the first end 14 of the main body 10 and are all configured for direction positioning.

With reference to FIGS. 1, 5, 8, 10 and 11, the main body 10 has two curved side surfaces 105 located on a long axis, two flush side surfaces 106 located on a short axis. The two curved side surfaces 105 extend curvedly, are respectively located on two opposite sides of the main body 10, and are located adjacent to an inner wall of the bottom of the container body A. The two flush side surfaces 106 extend flatly, are respectively located on another two opposite sides of the main body 10, and are connected to the two curved side surfaces 105. A distance L on a long axis between the two curved side surfaces 105 is larger than an inner diameter D1 of a can opening of the container body A. A distance W on a short axis between the two flush side surfaces 106 is smaller than the inner diameter D1 of the can opening of the container body A. In other words, the distance W on the short axis between the two flush side surfaces 106 is shorter than the distance L on the long axis between the two curved side surfaces 105, and the main body 10 is in a race track shape. By the distance W on the short axis between the two flush side surfaces 106 is smaller than the inner diameter D1 of the can opening of the container body A, the main body 10 is able to enter the can opening of the container body A.

With reference to FIGS. 1, 7, 10, and 11, in the first embodiment, the inner diameter D1 of the can opening of the container body A is 25.4 mm, an outer diameter D2 of the container body A is 38 mm, and an inner diameter of an inner annular wall of the container body A is 37.2 mm. A distance L between the two curved side surfaces 105 is set 36.4 mm. The axial center of the connecting port segment 101 is eccentrically located in a left part near a first end 14 of the upper segment 103 instead of in a center, which means a distance L2 between the axial center of the connecting port segment 101 and a second end 15 of the main body 10 is larger than a distance L1 between the axial center of the connecting port segment 101 and a first end 14 of the main body 10. Specifically, the distance L2 between the axial center of the connecting port segment 101 and the second end 15 of the main body 10 is 20 mm, and the distance L1 between the axial center of the connecting port segment 101 and the first end 14 of the main body 10 is 16.4 mm. Thus, setting the distance L (long axis) between the two curved side surfaces 105 to 36.4 mm (which is closest to the inner diameter 37.2 mm of the inner wall of the container body A) allows the extending liquid drawing openings 12 to extend as nearly as possible to the bottom corner of the container body A in multiple directions, so as to draw the liquid product C successfully. But the specifications and the configurations are not limited above. The axial center of the connecting port segment 101 can also be located in a right part near the second end 15 of the main body 10, herein a distance between the first end 14 and the axial center of the connecting port segment 101 is 20 mm, and a distance between second end 15 and the axial center of the connecting port segment 101 is 16.4 mm. Additionally, in the first embodiment, a width of the main body 10, which is also a distance W (short axis) between the two flush side surfaces 106, is 24 mm, but not limited thereto.

With reference to FIGS. 1, 5, 10, 11, and 12A to 12E, in the first embodiment, when installing the extending drawing unit into the liquid container body A, a user first tilts the main body 10 with respect to the container body A and manipulate the second end 15 into the can opening of the container body A. Then, the user tilt the main body 10 and manipulate the second end 15 that is already moved into the can opening of the container body A downward and attach to the inner wall of the container body A, so that the user can maneuver the first end 14 into the container body A and subsequently resume the upright position of main body 10 and the insertion of main body 10 is complete. The distance L on the long axis of main body 10 longer than the inner diameter of the can opening can thus be maneuvered into the container body A. Specifically, when installing the extending drawing unit into the container body A because the short axis W is set to be shorter than the inner diameter D1 of the can opening of the container body A. Thus, the main body 10 can easily be maneuvered into the container body A.

With reference to FIGS. 8, 9 and 10, in the first embodiment, the main body 10 has the through holes 107 formed through a top surface and a bottom surface of the main body 10. The configuration of the through holes 107 allows the flow of the liquid product C, thereby avoiding the main body 10 blocking the flow of the liquid product C no matter when the main body 10 being placed in the container body A or when the liquid product container being used.

With reference to FIGS. 1, 2, 5, 7, 8 and 10, in the first embodiment, the liquid dip tube B is polygonal in cross-section. An outer annular surface of the liquid dip tube B extends along an axial direction of the liquid dip tube B to two ends of the liquid dip tube B. In other words, an arc corner of the polygon liquid dip tube B extends along an axial direction of the liquid dip tube B to two ends of the liquid dip tube B. The connecting port segment 101 has an inner hole being polygonal in cross-section. The liquid product inlet is also polygonal in cross-section. A shape of the inner hole 102 of the connecting port segment 101 is the same as a shape of the liquid dip tube B on a cross-section perpendicular to the axial direction of the liquid dip tube B. A shape of the inner hole 32 of the liquid product inlet of the valve housing 31 is the same as the shape of the liquid dip tube B on the cross-section perpendicular to the axial direction of the liquid dip tube B. Therefore, a bottom end of the liquid dip tube B can engage with the inner hole 102 of the connecting port segment 101, and a top end of the liquid dip tube B can engage with the inner hole 32 of the liquid product inlet of the valve housing 31. Specifically, in the first embodiment, the liquid dip tube B is an isosceles triangular tube. The arc corner 108 (R corner) extends along an axial direction of the liquid dip tube B to two ends of the liquid dip tube B. The inner hole 102 of the connecting port segment 101 and the inner hole 32 of the liquid product inlet of the valve housing 31 are both isosceles triangular holes. When both ends of the liquid dip tube B are respectively inserted into the inner hole 102 of the connecting port segment 101 of the main body 10 and the inner hole 32 of the liquid product inlet of the valve housing 31, the arc corner 108 (R corner) of the liquid dip tube B, the arc corner 109 (small R corner) of the inner hole 102 of the connecting port segment 101 of the main body 10 and the arc corner 110 (small R corner) of the inner hole 32 of the liquid product inlet of the valve housing 31 are all aligned toward the first end 14 of the main body 10 in consistence with the same direction as the spray nozzle 21 of the actuator 20 and are all configured for direction positioning. But the structure is not limited to the abovementioned configuration, as the liquid dip tube B can adapt another shape of tube and the arc corner (R corner) configured for direction positioning can also adapt another shape.

Figure 4:
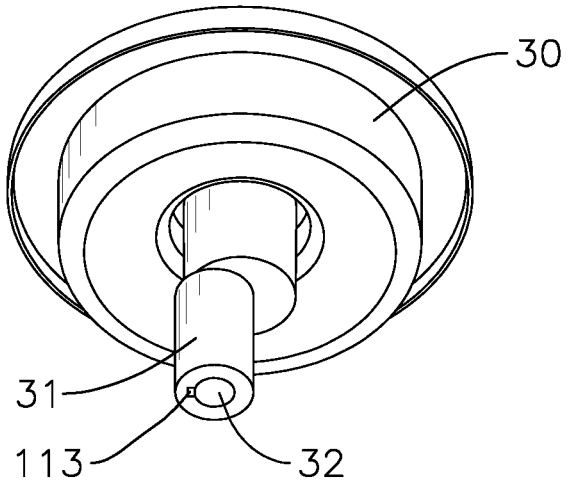
FIG. 4 is a bottom perspective view of the embodiment of the extending drawing unit in FIG. 3, showing the aerosol valve.

With reference to FIGS. 3 and 4, the liquid dip tube B in the present invention can also be a round tube, and the liquid dip tube B has a rib 111 for direction positioning is protruding from an outer annular surface of the round tube. The rib 111 extends along an axial direction of the liquid dip tube B to two ends of the liquid dip tube B. The shape of the inner hole 102 of the connecting port segment 101 is the same as a shape of the liquid dip tube B on a cross-section perpendicular to the axial direction of the liquid dip tube B. A bottom end of the liquid dip tube B and the connecting port segment 101 are configured to engage with each other. A shape of the inner hole 32 of the liquid product inlet of the valve housing 31 is the same as a shape of the liquid dip tube B on a cross-section perpendicular to the axle direction. A top end of the liquid dip tube B and the inner hole 32 of the liquid product inlet of the valve housing 31 are configured to engage with each other. Two ends of the rib 111 of the round tube engage with a positioning groove 112 in the inner hole 102 of the connecting port segment 101 and respectively the positioning groove 113 of the inner hole 32 of the liquid product inlet of the valve housing 31.

Figure 6:
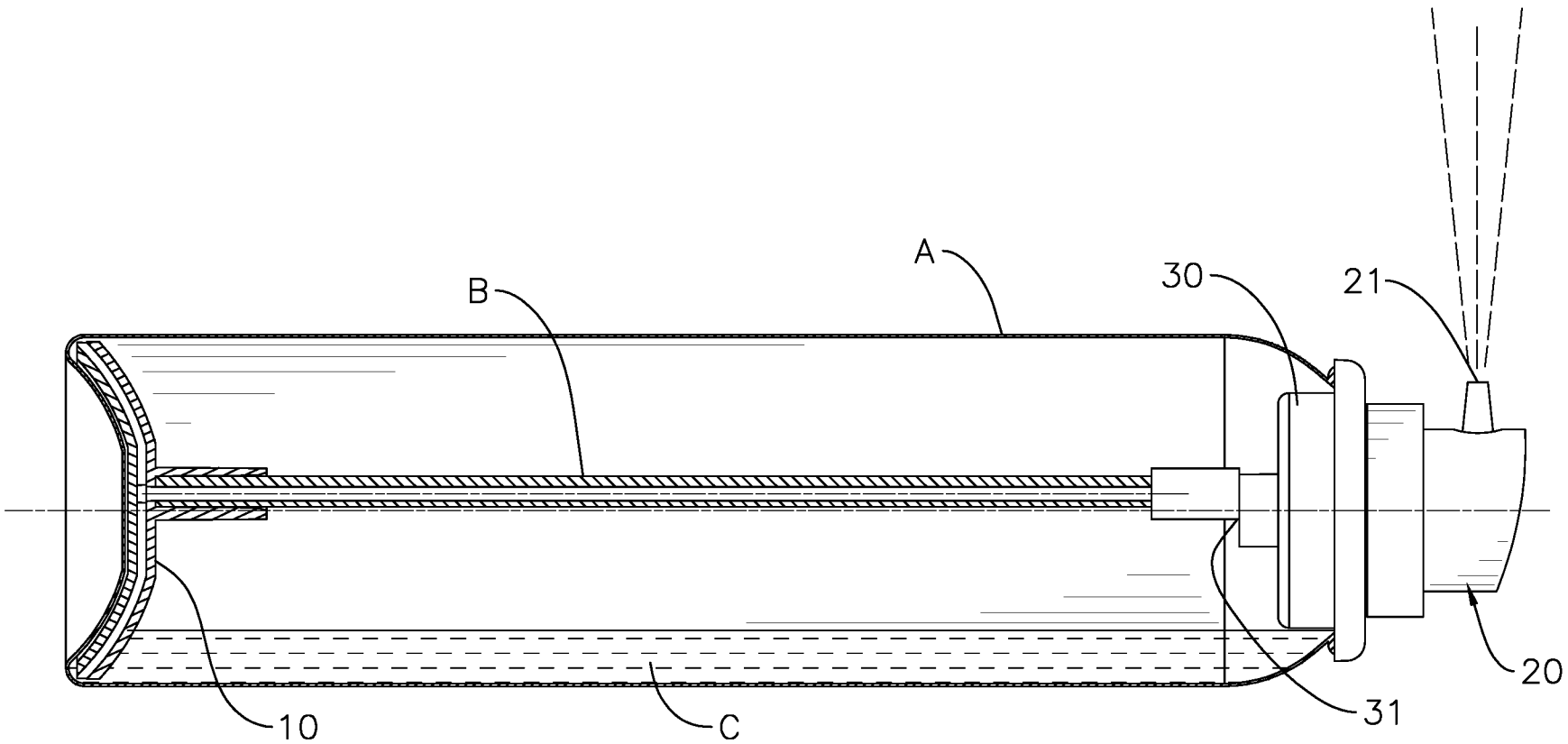
FIG. 6 is another side view in cross-section of the first embodiment of the extending drawing unit in FIG. 1, showing the container body placed horizontally to spray.

With reference to FIGS. 5 and 6, as described above, a liquid dip tube in a conventional liquid product container usually extends curvedly with a drawing end opening toward a same direction as a spray nozzle of the actuator mounted on a top of a container body of the conventional liquid product container. When capacity of liquid product C in the container body A is only a half or less, if the container body is placed with the actuator lean back or placed horizontally, the actuator cannot spray out the liquid product C even though there is remaining of the liquid product C. In the extending drawing unit of the present invention, with the multiple extending liquid drawing openings 12, the liquid product C remaining in the bottom corner of the container body in multiple directions can be drawn out. In short, in addition to spray by holding the liquid product container upside down, the liquid product container with the extending drawing unit in the present invention can spray out the liquid product C in the container body A almost completely, thereby avoiding waste caused by too much liquid product C remaining in the container body that cannot be sprayed out, which is the advantage that the conventional liquid product container (with straight dip tube or with a distal end of a dip tube attaching a bottom corner of the container body) does not have.

With reference to FIGS. 13 to 18, a structure and function of a second embodiment of the present invention is basically the same as the first embodiment, so the configuration and technical characteristics of the cross-section shape of the liquid dip tube B, the shape of the inner hole of the liquid product inlet of the valve housing, the shape of the inner hole of the connecting port segment, the small R corner, confluence suction port, multiple extending liquid drawing passages and multiple extending liquid drawing openings, etc. will not be detailed below.

In the second embodiment, a press-type spray pump 33 and a plastic (such as PET) container body A are applied. An outer diameter of the container body A is set to be 48 mm and an inner diameter of the can opening of the container body A is set to be 33.6 mm. Thus, the distance L on the long axis between the two curved side surfaces 105 is set to be 44 mm and the distance W on the short axis between the two flush side surfaces 106 is designed as 31.6 mm. In the second embodiment, uncompressed air is inside the container body A and a bottom wall of the container body A is flat but not bumped, so the bottom of the main body 10B is a flat board. The axis of the connecting port segment 101B of the main body 10B is connected to the liquid dip tube B that is an isosceles triangle tube. The main body 10B has multiple extending liquid drawing passages 11B. The extending liquid drawing passages 11B respectively form multiple extending liquid drawing openings 12B on an annular side surface of the main body 10B. The extending liquid drawing openings 12B are arranged annularly and are spaced apart from each other. Thus, the second embodiment achieves the same effect as the first embodiment. In the second embodiment, the axis of the connecting port segment 101B is located in the center of the upper segment 103B instead of being located in the left part. But the configuration is not limited thereto, as the connecting port segment 101B can also be located in the left part or in the right part and position toward the first end 14 or the second end 15 of the main body 10B. Specifically, two ends of the isosceles triangular liquid dip tube B respectively connected to the inner hole 102B of the connecting port segment 101B and the inner hole 32B of the liquid product inlet of the valve housing 31B. When the actuator 20B is pressed, the liquid product C in the container body A flows sequentially through the multiple extending liquid drawing openings 12B, the multiple extending liquid drawing passages 11B, the confluence suction port 1011B and the liquid dip tube B and then into the liquid product inlet of the valve housing 31B, and then can be sprayed out via the spray nozzle 21B. In the second embodiment, the installation procedures of the extending drawing unit into the container body A are the same as the first embodiment and thus will not be detailed below. The press-type spray pump 33 is conventional and will not be detailed below.

The following table lists the specifications of the first embodiment and the second embodiment of the present invention.

| | first embodiment | second embodiment |
|---|---|---|
| can opening inner diameter (D1) | 25.4 mm | 33.6 mm |
| container body outer diameter (D2) | 38.0 mm | 48.0 mm |
| container body inner diameter | 37.2 mm | 47.2 mm |
| main body long axis length (L) | 36.4 mm | 44 mm |
| Main body short axis length (W) | 24.0 mm | 31.6 mm |
| main body shape | Curved board | Flat board |
| Location of the connecting port segment on the upper segment | Left portion (near the first end 14) | Center |
| Number of the extending liquid drawing openings | Four | Four |
| Aerosol valve or spray pump | Aerosol valve | Spray pump (such as Press-type spray pump etc.) |
| Form of propellant | High-pressure air (such as environmental friendly refrigerant etc.) | Uncompressed air |
| Material of the container body | Metal | Plastic |

With reference to FIGS. 19 to 26, a structure and function of a third embodiment of the present invention is basically the same as the first embodiment, so the configuration and technical characteristics of the cross-section shape of the liquid dip tube B, the shape of the inner hole of the liquid product inlet of the valve housing, the shape of the inner hole of the connecting port segment, each small R corner and confluence suction port etc. will not be detailed below. The differences between the first embodiment and the third embodiment are mainly in the structure of multiple liquid passages as instructed below. In the first embodiment, the extending liquid drawing passages 11 are formed by the grooves 13 of the lower segment 104 and the bottom surface of the upper segment 103. But in the third embodiment, the main body 10C comprises multiple soft tubes 16C and the multiple extending liquid drawing passages 11C are respectively formed in the multiple soft tubes 16C. In the third embodiment, the connecting port segment 101C is formed on the top of the upper segment 103C, the bottom surface of the upper segment 103C has multiple grooves 17C, the cross section of multiple grooves 17C is in semicircular shape, and a part of the soft tubes 16C is mounted on the grooves 17C of the upper segment 103C. The multiple grooves 13C are also formed on the top surface of the lower segment 104C, and the cross section of multiple grooves 13C is in semicircular shape, and another part of the soft tubes 16C is mounted on the grooves 13C of the lower segment 104C. By this configuration, when the upper segment 103C and the lower segment 104C are combined, the multiple soft tubes 16C are clamped between the upper segment 103C and the lower segment 104C. The multiple extending liquid drawing passages 11C are respectively formed in the soft tubes 16C, and the multiple liquid drawing openings 12C are respectively formed on outer ends of the multiple soft tubes 16C.

Inner ends of the multiple soft tubes 16C are connected to the connecting port segment 101C. The extending liquid drawing openings 12C on the outer ends of the soft tube 16C protrude from the side surface of the main body 10C. Specifically, in the third embodiment, the multiple extending liquid drawing passages 11C are formed in the multiple soft tubes 16C and the multiple soft tubes 16C are clamp between the upper segment 103C and the lower segment 104C.

The multiple extending liquid drawing passages 11C, through multiple soft tubes 16C, protrude from the upper segment 103C and the lower segment 104C. The multiple extending liquid drawing openings 12C are respectively formed on the end of the multiple soft tubes 16C surrounding the main body 10C. Specifically, the multiple extending liquid drawing openings 12C are connected to the multiple extending liquid drawing passages 11C and extend to the confluence suction port 1011C; thus the multiple extending liquid drawing openings 12C are connected to the liquid dip tube B. Specifically, the two ends of the liquid dip tube B are respectively connected to the inner hole 102C of the connecting port segment 101C and the inner hole 32C of the liquid product inlet of the valve housing 31C. When the actuator 20C is pressed, the liquid product C in the container body A sequentially flows through the multiple extending liquid drawing openings 12C, the multiple extending liquid drawing passages 11C, the confluence suction port 1011C and the liquid dip tube B and then into the inner hole 32C of the liquid product inlet of the valve housing 31C, and then can be sprayed out via the spray nozzle 21C, and thus the third embodiment achieves the same effect as the first embodiment.

With reference to FIGS. 22 and 23A to 23C, a structure of a third embodiment of the present invention has the soft tubes 16C, a volume of the main body 10C can be reduced, and the length of the soft tubes 16C of main body 10 can be adjusted according to the inner diameter of different container body A. The soft tubes 16C can be bent and then moved into the can opening of the container body A along with the main body 10C. Because the soft tubes 16C with elastic potential energy are flexible to resume their functional shape for liquid suction. The soft tubes 16C are made of, preferably, LDPE (Low-density polyethylene). An inner diameter of each of the soft tubes 16C is, preferably, 1.3 mm, and an outer diameter of each of the soft tubes 16C is 1.9 mm. But the material and the specification are not limited thereto. In the third embodiment, the installation procedures of the extending drawing unit into the container body A are the same as first embodiment and thus will not be detailed below. Additionally, the extending drawing unit having the soft tubes 16C can be applied in the aerosol valve 30 and the press-type spray pump 33 etc.

The advantages of the liquid product container of the present invention are as follows. The main body 10 is located in the container body A and extends to the bottom edge of the container body A. The main body 10 forms multiple extending liquid drawing passages 11 inside, and the extending liquid drawing passages 11 extend along the radial direction of the container body A and respectively form multiple extending liquid drawing openings 12 which are spaced apart to each other and are arranged annularly on the side surface of the main body 10. Therefore, the extending liquid drawing openings 12 are close to the bottom corner where the can wall and the can bottom connect to each other. Besides, the connecting port segment 101 connects the liquid dip tube B and the extending liquid drawing passages 11 so the liquid dip tube B connects the extending liquid drawing openings 12, and thus the liquid dip tube B can be extended to the bottom corner of the container body A in multiple directions. By the abovementioned configurations, even though the capacity of the liquid product C in the container body A is only a half or less, when the user changes the container body A upright to use in a reclined state or in a horizontal state, there will be at least one extending liquid drawing opening 12 submerged in the liquid product C, such that the liquid dip tube B can draw the liquid product C in different directions, thereby the actuator sprays the liquid product C correctly and smoothly. Further, the present invention can use high-pressure air such as environmental friendly refrigerant (HFO-1234yf) as well as uncompressed air by being used with the aerosol valve 30 or the press-type spray pump 33 that has a function of spraying or drawing liquid. Moreover, the extending drawing unit of the present invention may also be used with accessories with suction function, such as teats on baby bottle, so the present invention can be applied in any kind of liquid product C. In short, the present invention can spray out or draw out almost all of the liquid product C in the container body A, so as to avoid waste due to excess liquid product C remaining in the container body A, which is an advantage that the liquid dip tube of the conventional liquid product container does not have.

In summary, the present invention can spray out the liquid product C in the container body A almost completely, thereby avoiding trouble and waste caused by too much liquid product C remaining in the container body A that cannot be sprayed out.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An extending drawing unit adapted to be mounted in a container body of a liquid product container and be connected to a liquid dip tube; the extending drawing unit comprising:

a main body adapted to be mounted in the container body, adapted to extend to a bottom edge of the container body, and having an upper segment and a lower segment assembled with the upper segment; the main body having multiple extending liquid drawing passages formed inside the main body and between the upper segment and the lower segment; each one of the extending liquid drawing passages extending along a respective one of radial directions of the container body; the extending liquid drawing passages respectively forming multiple extending liquid drawing openings on an annular side surface of the main body; the extending liquid drawing openings arranged annularly, spaced apart from each other, and adapted to be located in the bottom edge of the container body; the main body having a connecting port segment formed on the upper segment and opposite to the lower segment, connected to the extending liquid drawing passages and adapted to be connected to the liquid dip tube, such that the liquid dip tube is connected to the extending liquid drawing openings.

2. The extending drawing unit as claimed in claim 1, wherein the liquid product container for mounting the extending drawing unit is a spray can.

3. The extending drawing unit as claimed in claim 1, wherein the main body is a board; the extending liquid drawing openings are formed on an annular surface of the board; the connecting port segment is located on a top side surface of the board; the annular surface of the board is connected to an edge of the side surface of the board and extends along the edge of the side surface of the board.

4. The extending drawing unit as claimed in claim 1, wherein the lower segment has multiple grooves formed on a top surface of the lower segment; the grooves of the lower segment are covered by a bottom surface of the upper segment to form the extending liquid drawing passages.

5. The extending drawing unit as claimed in claim 1, wherein a confluence suction port is formed in an axial center of an inner hole of the connecting port segment of the upper segment and formed through a bottom surface of the upper segment; the confluence suction port is located above a confluence of the extending liquid drawing passages and is connected to the extending liquid drawing passages.

6. The extending drawing unit as claimed in claim 1, wherein the main body has two curved side surfaces extending curvedly, respectively located on two opposite sides of the main body, and adapted to be located adjacent to an inner wall of the container body; a distance between the two curved side surfaces larger than an inner diameter of a can opening of the container body; and two flush side surfaces extending flatly, respectively located on another two opposite sides of the main body, and connected to the two curved side surfaces; a distance between the two flush side surfaces smaller than the inner diameter of the can opening of the container body.

7. The extending drawing unit as claimed in claim 1, wherein the main body has multiple through holes formed through a top surface and a bottom surface of the main body.

8. The extending drawing unit as claimed in claim 1, wherein the liquid dip tube is polygonal in cross-section; an outer annular surface of the polygonal tube extending along an axial direction of the liquid dip tube to two ends of the liquid dip tube;

a shape of an inner hole of the connecting port segment is the same as a shape of the liquid dip tube on a cross-section perpendicular to the axial direction of the liquid dip tube; and the liquid dip tube and the connecting port segment are configured to engage with each other.

9. A liquid product container comprising:

a container body being hollow and having an installing opening;

a valve sealed on the installing opening of the container body; the valve has a liquid product inlet and a liquid product outlet; the liquid product inlet located in the container body; the liquid product outlet located outside the container body; the liquid product inlet connected to the liquid product outlet;

a liquid dip tube; and an extending drawing unit having a main body adapted to be mounted in the container body, adapted to extend to a bottom edge of the container body, and having an upper segment and a lower segment assembled with the upper segment; the main body having multiple extending liquid drawing passages formed inside the main body and between the upper segment and the lower segment; each one of the extending liquid drawing passages extending along a respective one of radial directions of the container body; the extending liquid drawing passages respectively forming multiple extending liquid drawing openings on an annular side surface of the main body; the extending liquid drawing openings arranged annularly, spaced apart from each other, and adapted to be located in the bottom edge of the container body; the main body having a connecting port segment formed on the upper segment and opposite to the lower segment, connected to the extending liquid drawing passages and adapted to be connected to the liquid dip tube, such that the liquid dip tube is connected to the extending liquid drawing openings.

10. The liquid product container as claimed in claim 9, wherein the liquid product container is a spray can.

11. The liquid product container as claimed in claim 9, wherein the liquid dip tube is a polygonal tube; an outer annular surface of the polygonal tube extending along an axial direction of the liquid dip tube to two ends of the liquid dip tube;

a shape of an inner hole of the connecting port segment is the same as a shape of the liquid dip tube on a cross-section perpendicular to the axial direction of the liquid dip tube; and the liquid dip tube and the connecting port segment are configured to engage with each other.

12. The liquid product container as claimed in claim 9, wherein the liquid dip tube is polygonal in cross-section; an outer annular surface of the polygonal tube extending along an axial direction of the liquid dip tube to two ends of the liquid dip tube;

a shape of an inner hole of the liquid product inlet is the same as a shape of the liquid dip tube on a cross-section perpendicular to the axial direction of the liquid dip tube; and the liquid dip tube and the liquid product inlet are configured to engage with each other.

13. An extending drawing unit adapted to be mounted in a container body of a liquid product container and be connected to a liquid dip tube; the extending drawing unit comprising:

a liquid dip tube; and a main body adapted to be mounted in the container body, adapted to extend to a bottom edge of the container body, and having an upper segment and a lower segment assembled with the upper segment; the main body having multiple extending liquid drawing passages formed inside the main body and between the upper segment and the lower segment; the extending liquid drawing passages extending along a radial direction of the container body and respectively forming multiple extending liquid drawing openings on a side surface of the main body; the extending liquid drawing openings arranged annularly, spaced apart from each other, and adapted to be located in the bottom edge of the container body; the main body having a connecting port segment formed on the upper segment and opposite to the lower segment, connected to the extending liquid drawing passages and adapted to be connected to the liquid dip tube, such that the liquid dip tube is connected to the extending liquid drawing openings.

14. The extending drawing unit as claimed in claim 13, wherein the liquid product container for mounting the extending drawing unit is a spray can.

15. The extending drawing unit as claimed in claim 13, wherein the liquid dip tube is polygonal in cross-section; an outer annular surface of the polygonal tube extending along an axial direction of the liquid dip tube to two ends of the liquid dip tube;

a shape of an inner hole of the connecting port segment is the same as a shape of the liquid dip tube on a cross-section perpendicular to the axial direction of the liquid dip tube; and the liquid dip tube and the connecting port segment are configured to engage with each other.

16. The extending drawing unit as claimed in claim 13, wherein the liquid dip tube has a round tube;

a rib protruding from an outer annular surface of the round tube and extending along an axial direction of the liquid dip tube to two ends of the liquid dip tube;

a shape of an inner hole of the connecting port segment is the same as a shape of the liquid dip tube on a cross-section perpendicular to the axial direction of the liquid dip tube; and the liquid dip tube and the connecting port segment are configured to engage with each other.

* * * * *